US010358190B2

(12) United States Patent
Jørgensen

(10) Patent No.: US 10,358,190 B2
(45) Date of Patent: Jul. 23, 2019

(54) LIFEBOAT RELEASE AND RETRIEVAL SYSTEM (LRRS)

(71) Applicant: MSI AS, Nøtterøy (NO)

(72) Inventor: Ragnar Jørgensen, Nøtterøy (NO)

(73) Assignee: MSI AS, Nøtterøy (NO)

( * ) Notice: Subject to any disclaimer, the term of this patent is extended or adjusted under 35 U.S.C. 154(b) by 0 days.

(21) Appl. No.: 15/309,990

(22) PCT Filed: May 29, 2015

(86) PCT No.: PCT/NO2015/050095
§ 371 (c)(1),
(2) Date: Nov. 9, 2016

(87) PCT Pub. No.: WO2015/183101
PCT Pub. Date: Dec. 3, 2015

(65) Prior Publication Data

US 2017/0247088 A1 Aug. 31, 2017

(30) Foreign Application Priority Data

May 30, 2014 (NO) ..... 20140671

(51) Int. Cl.
*B63B 23/00* (2006.01)
*B63B 23/58* (2006.01)
*B63B 23/28* (2006.01)

(52) U.S. Cl.
CPC ..... *B63B 23/58* (2013.01); *B63B 23/28* (2013.01)

(58) Field of Classification Search
CPC ..... B63B 23/00; B63B 23/28; B63B 23/40; B63B 23/58

(Continued)

(56) References Cited

U.S. PATENT DOCUMENTS 1,246,468 A * 11/1917 Robinson ..... B63B 23/58 114/380
1,742,092 A * 12/1929 Overman ..... B63B 23/58 114/380

(Continued)

FOREIGN PATENT DOCUMENTS

GB 191222559 A 7/1913
GB 292259 A 6/1928

(Continued)

OTHER PUBLICATIONS

Åhlander, Anna, "International Search Report," prepared for PCT/NO2015/050095, dated Sep. 15, 2015, five pages.

*Primary Examiner* — Daniel V Venne
(74) *Attorney, Agent, or Firm* — Winstead PC

(57) ABSTRACT

A lifeboat hook assembly comprising a hook-shaped beak (5) and a release mechanism (6), said hook shaped beak (5) is rigidly connected to a lifeboat (2) at one end, said hook shaped beak (5) having a downwardly oriented shoulder (18) against which a loop (17) is adapted to rest so that the lifeboat is suspended in said loop (17), said release mechanism (6) is coupled to the hook-shaped beak (5) and is adapted to move relative to the hook-shaped beak (5) between a locked position (8*a*, 10*a*) wherein the loop is prevented from escaping from the shoulder (18), and a releasing position (8*e*, 10*e*) wherein the loop (17) is allowed to escape from the shoulder (18), an actuator (11) is coupled to the release mechanism (6) and is adapted to move the release mechanism (6) between the locked position (8*a*, 10*a*) and the releasing position (8*e*, 10*e*). The invention being distinctive in that said hook shaped beak (5) or said release mechanism has a first guide slot (7) and a second guide slot (9), said other of said hook shaped beak (5) or release mechanism (6) has a first guide pin (8) and a second guide pin (10), said first guide pin (7) being adapted to engage with (Continued)

the first guide slot (8), said second guide pin (10) being adapted to engage with the second guide slot (9).

14 Claims, 19 Drawing Sheets

(58) Field of Classification Search
USPC ..... 114/377, 378, 380
See application file for complete search history.

(56) References Cited

U.S. PATENT DOCUMENTS 2,714,731 A * 8/1955 Binmore ..... B63B 23/58 114/378
2,800,667 A * 7/1957 Staudt ..... B63B 23/58 114/380
3,918,758 A 11/1975 Fournier
4,281,867 A * 8/1981 Kariagin ..... B63B 23/58 114/378
4,348,043 A * 9/1982 Fandel ..... F16B 45/00 114/378
4,461,233 A * 7/1984 Nilsson ..... B63B 23/58 114/365
4,610,474 A 9/1986 Jaatinen
5,078,073 A * 1/1992 Betz ..... B63B 23/60 114/377
7,360,498 B1 * 4/2008 Mora ..... B63B 21/08 114/378
7,832,350 B2 * 11/2010 Mora ..... B63B 23/58 114/378
8,813,549 B1 * 8/2014 Pao ..... B63B 23/58 114/365
9,021,977 B2 * 5/2015 Mora ..... B63B 23/58 114/378
2011/0132253 A1 * 6/2011 Nielsen ..... B63B 23/58 114/377
2012/0125252 A1 5/2012 Nielsen

FOREIGN PATENT DOCUMENTS

GB 343284 A 2/1931
GB 989871 A 4/1965
JP S6029388 A 2/1985
SE 8498 C1 11/1897

* cited by examiner

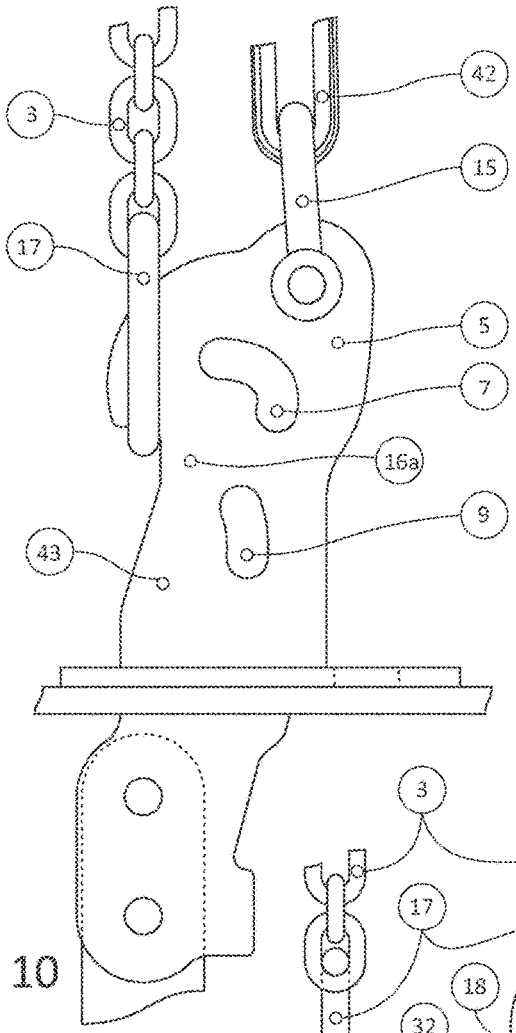
Fig. 10
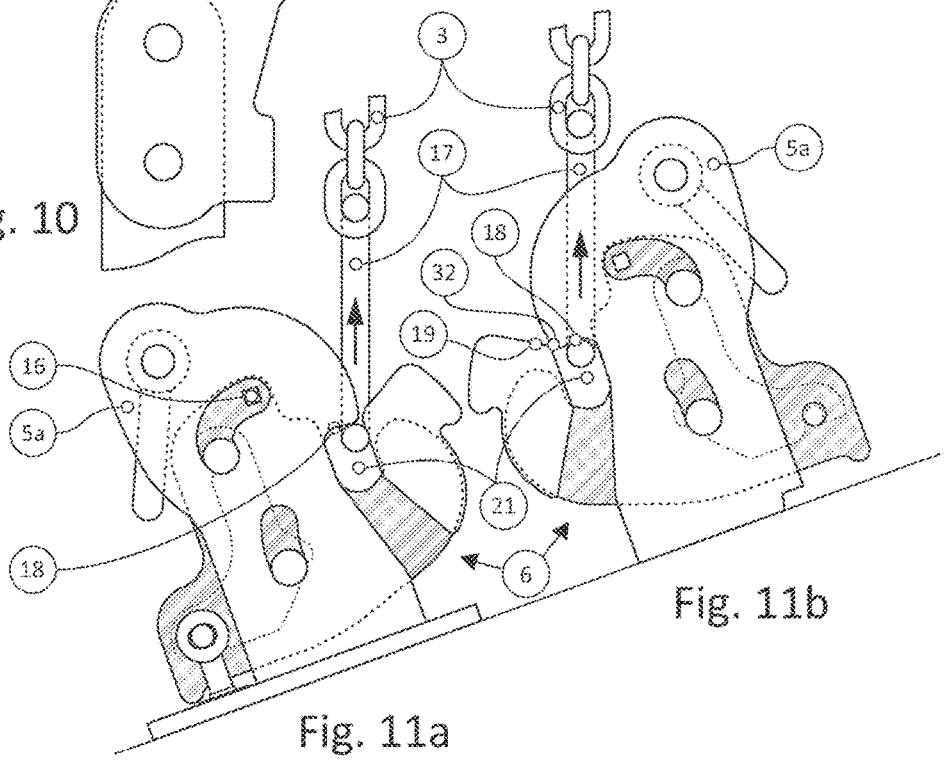
Fig. 11b
Fig. 11a

LIFEBOAT RELEASE AND RETRIEVAL SYSTEM (LRRS)

FIELD OF THE INVENTION

The present invention relates to a coupling suitable for handling of loads such as lifesaving equipment.

More particularly the present invention relates to a release and retrieval system with a mechanism adapted to release or retrieve of liftable installations such as lifeboats that are lowered to the surface of the sea from vessels, platforms, rigs etc., or lifeboats of the free fall type, which under launch are free falling from vessels, platforms, rigs etc.

The release and retrieve system has both on-load and off-load functionalities.

BACKGROUND OF THE INVENTION AND PRIOR ART

The UN's International Maritime Organization IMO introduced requirement for on-load release hooks on all ships applicable for all ships built after Jul. 1, 1986 to ensure that the lifeboats could be released easily and quickly in an emergency evacuation situation.

There are three types of lifeboat releasing mechanism, on-load and off-load release and release hooks for free fall lifeboats. The first two mentioned mechanisms release the lifeboat from the lowering mechanism or davit, which is attached to a wire or loop. By releasing the loop, the lifeboat can be set free to propel away from the ship.

Lifeboats with off-load mechanism may only be released when the lifeboat is into the sea and fully buoyant and hence the fall is un-loaded. Release require manual action by the lifeboat crew—a dangerous action often proved difficult as even un-loaded falls may be influenced by outside forces from the mothership's possible remaining speed through the water, wind, waves, heeling etc.

An on-load mechanism can release the lifeboat from the wire, with the lifeboat above the water level and with all the crewmembers onboard the boat. The load will be still on the fall as the lifeboat would not have touched the water. A release handle or similar is provided onboard inside the lifeboat to operate this mechanism.

The third release mechanism is hook for free-fall lifeboats. In these types of lifeboats there is only one hook, arranged at the rear end of the lifeboat, holding the lifeboat. When this hook is released, the lifeboat drops into the water.

Traditionally, lifeboats were suspended from two off-load hooks. It is therefore impossible to release loaded hooks, and it could also be problematic to release the hooks with certainty and simultaneously, even with the lifeboat in the water, especially during evacuation in high seas.

There are many weaknesses also with the existing on-load release systems. There have been cases where the lifeboats have dropped during exercises, both during lowering and hoisting, with or without people onboard. These accidents often occur from the deck of the ship when the lowering or lifting process gets to a stop or a significant jerk occurs.

There could also be a failure because the on-load hooks are not properly reset. These hooks can release unintentionally when hoisting the lifeboat or during the next lowering of the lifeboat.

There is also a problem that one of the hooks may release unintentionally alone or before the other one releases. This has on occasions led to a situation where the lifeboat has fallen upside down into the water.

Other reasons for failure are lack of maintenance of the hooks or an overly complex construction of the on-load hooks, so that there is a risk that the parts of the hooks are not assembled correctly.

Lack of skills of the person who is to release or secure of the on-load hooks is also a cause for accidents.

Other reasons for failure of on-load hooks are the use of wrong materials in the hooks.

Due to the many dramatic accidents, some of them fatal, with the new on-load release mechanisms, the IMO has changed the regulations, so that it is no longer a requirement to have people aboard lifeboats during the lowering and reversible handling during exercises. This has led to fewer accidents, but has increased the seafarers' skepticism to the lifeboat as a lifesaver. Is it considered dangerous to be in the lifeboat during exercise, leading to the view that it is even more dangerous to be in the lifeboats during emergency situations.

Publication US20120125252 shows a coupling for coupling a fall to a lifeboat. The coupling comprising a locking portion that has the shape of a spherical ball and a receiving portion shaped as a hollow. In the locked position, the locking portion is secured within the receiving portion by a spring or a pawl when the fall is slack. To release the locking portion from the receiving portion, actuators are pushing the locking portion from the receiving portion. When the fall is slack it is just the spring or pawl that is preventing the release of the locking portion. If there is a failure in the spring or pawl, this could lead to unintentional release. There is also no easy retrieval of the coupling without the use of hands.

Publication U.S. Pat. No. 4,610,474 shows a release hook for lifeboats. It comprises a hook with spaced apart guide pins. Supporting plates with spaced apart guide slots are affixed to the lifeboat. The guide pins of the hook are engaging in the guiding slots of the supporting plates, and the hook is adapted to move between a loop-engaging loaded position and a loop disengaging position. The hook is also the release mechanism and is moved within the guide slots by a piston pushing against the lower part of the hook. A bolt pin or stop secures the cable or chain link attached to the lowering arrangement inside the hook. In this publication, the cable or chain link is attached to the movable hook and the hook is also receiving the total load acting on the hook arrangement.

This results in an undesirable and dangerous strain on the hook as the moveable hook has to carry the full load of the lifeboat, a failure in the hook could result in an accidental release of the hook and lifeboat from the lowering arrangement.

GB292259 and GB225591912 both shows another lifeboat hook assemblies comprising a hook-shaped beak and a release mechanism, the release mechanism is adapted to move relative to the hook shaped beak between a locked position and a released position.

In publication GB292259, the hook shaped beak having a guide pin slidably connected to a guide slot in the release mechanism.

None of the publications shows a lifeboat hook assembly where the release mechanism having at least two guide pins adapted to engage with corresponding guide slot in the hook shaped beak. This provides a more reliable and secure hook assembly than the previous publications.

Objective of the Invention

The objective of the present invention is to minimize the risk of failure and accidental release when lowering or hoisting a lifeboat attached to lifting arrangements. The hook should work securely as expected in various situations.

It is also an objective of the present invention to have a construction where there are no moving load bearing parts, which will provide an improved sustainability.

It is also an objective of the invention to meet current requirements and future requirements of lifeboat hooks for both davit and free fall lifeboats. It is another objective of the present invention to provide a construction where the release mechanism does not have to carry the weight of the lifeboat. Other on-load hooks need a momentum to operate as expected. The construction should also work equally well in on-load and off-load release situations.

It is another objective of the present invention to provide a construction where the release mechanism is unloaded in the locked position and a force has to be applied to the mechanism to move it out of this position.

This results in reduced danger for inadequate use, unintended release and inadequate locking.

The undercut shape of one of the guide slot results in that the release mechanism is held in the locked position until the force is applied by the piston arrangement or the actuator.

Another objective of the present invention is to reduce the physical handling when lowering or lifting a lifeboat. There should also be no need for applying great force from persons onboard the lifeboat to release the lifeboat.

It is another objective of the present invention to provide an easy reverse action without use of hands on the hook components to retrieve the lifeboat after evacuation drills.

This will also reduce the physical handling of the operation and minimize injuries and accidents. A wire or rope could also act as an anchor pile to the support vessel, mother ship or similar where lifeboat is released from to prevent the lifeboat to slip away.

It is another objective of the present invention to provide an arrangement where simultaneous release of both of the hook arrangement on the lifeboat are ensured.

It is yet another objective of the invention to obtain a construction that have corrosion resistant materials and also have a simple and visible function with few components and is easy to maintain.

It is yet another objective of the invention to provide an arrangement that is designed for extreme conditions, including icing, etc.

The force applied from the actuator could break ice-crystals on the hook arrangement.

SUMMARY OF THE INVENTION

The invention relates to a lifeboat hook assembly comprising a hook-shaped beak and a release mechanism, said hook shaped beak is rigidly connected to a lifeboat at one end, said hook shaped beak having a downwardly oriented shoulder against which a loop is adapted to rest so that the lifeboat is suspended in said loop, said release mechanism is coupled to the hook-shaped beak and is adapted to move relative to the hook-shaped beak between a locked position wherein the loop is prevented from escaping from the shoulder, and a releasing position wherein the loop is allowed to escape from the shoulder, an actuator is coupled to the release mechanism and is adapted to move the release mechanism between the locked position and the releasing position. The invention is distinctive in that said hook shaped beak has a first guide slot and a second guide slot, said release mechanism has a first guide pin and a second guide pin, said first guide pin being adapted to engage with the first guide slot, said second guide pin being adapted to engage with the second guide slot.

This provides a safe and reliable hook arrangement for releasing and retrieving of a lifeboat.

A first and second guide slots with guide pins provides safe and steady movement of the release mechanism of the hook arrangement.

This also provides a sufficient torque in the movement of the release mechanism, for instance to break ice-coating which has settled on the hook arrangement.

Preferably, a lifeboat hook assembly having a loop displacing mechanism adapted to push the loop away from the shoulder.

This provides a second safety arrangement where the loop is adapted to rest on the shoulder in the locked position in addition to the locked position of the beak. A displacing mechanism must push the loop from the shoulder in order to release the loop from the hook arrangement.

Preferably, the loop displacing mechanism comprises an edge connected to the release mechanism.

This provides an easy and safe arrangement where the moving of the wedge tip to a releasing position and the displacing mechanism operates simultaneously to release the loop.

Preferably, the guide pins are movable along the respective guide slots.

This provides a movement of the release mechanism defined by the shape of the guide slot.

Preferably, a first end of the first guide slot has an undercut.

This provides a self-locking of the hook in the locked position since the piston arrangement has to force the first guide pin out of this position to release the loop.

Preferably, the actuator is adapted to move in the direction along the hook arrangements main axis.

This provides an arrangement that provides sufficient force to the release mechanism towards a release position.

Preferably, the second slot is shaped as an elongated slot extending along the main axis of the hook arrangement with a slightly curved second end.

This provides a stabilizing arrangement and prevents lateral movement towards the cylinder.

Preferably, the actuator is hydraulic.

This provides a safe and reliable releasing or locking of the hook arrangement and minimizes the physical handling of the hook arrangement and prevents therefore accidents etc. The force applied to the release mechanism could also be greater than hand power.

Preferably, one hook assembly is arranged on the lifeboat.

This provides a hook arrangement that is suitable for free fall lifeboats.

Preferably, two hook assemblies are arranged at each end of the lifeboat for simultaneous operation.

This provides a hook arrangement that is suitable for off-load or on-load release of two hook arrangements simultaneously.

Preferably, a first safety bore is arranged on the top of the hook-shaped beak and is adapted to engage with a securing element.

This provides a mechanical safety mechanism for maintenance of the hook arrangement or testing of the hydraulic system.

Preferably, second safety bore mechanism is arranged on the release mechanism and is adapted to engage with a stick or lever for manually rotating the release mechanism.

This provides a mechanical safety mechanism by for instance maintenance of the hook arrangement or testing of the hydraulic system, to move the release mechanism mechanically or to hold the release mechanism in a preferred position mechanically.

Preferably, the plate safety bore of the release mechanism, and a corresponding beak safety bore of the hook-shaped beak are adapted to engage with a stick or lever for securing the release mechanism in one position.

This provides an additional safety arrangement to maintain the hook arrangement in the locked position.

Preferably the guide slots are formed in the hook-shaped beak.

Preferably the actuator is coupled to a linear solenoid.

FIGURES

The invention will now be explained in detail with reference to the accompanying drawings, in which.

Figures 3A, 3B, 3C:
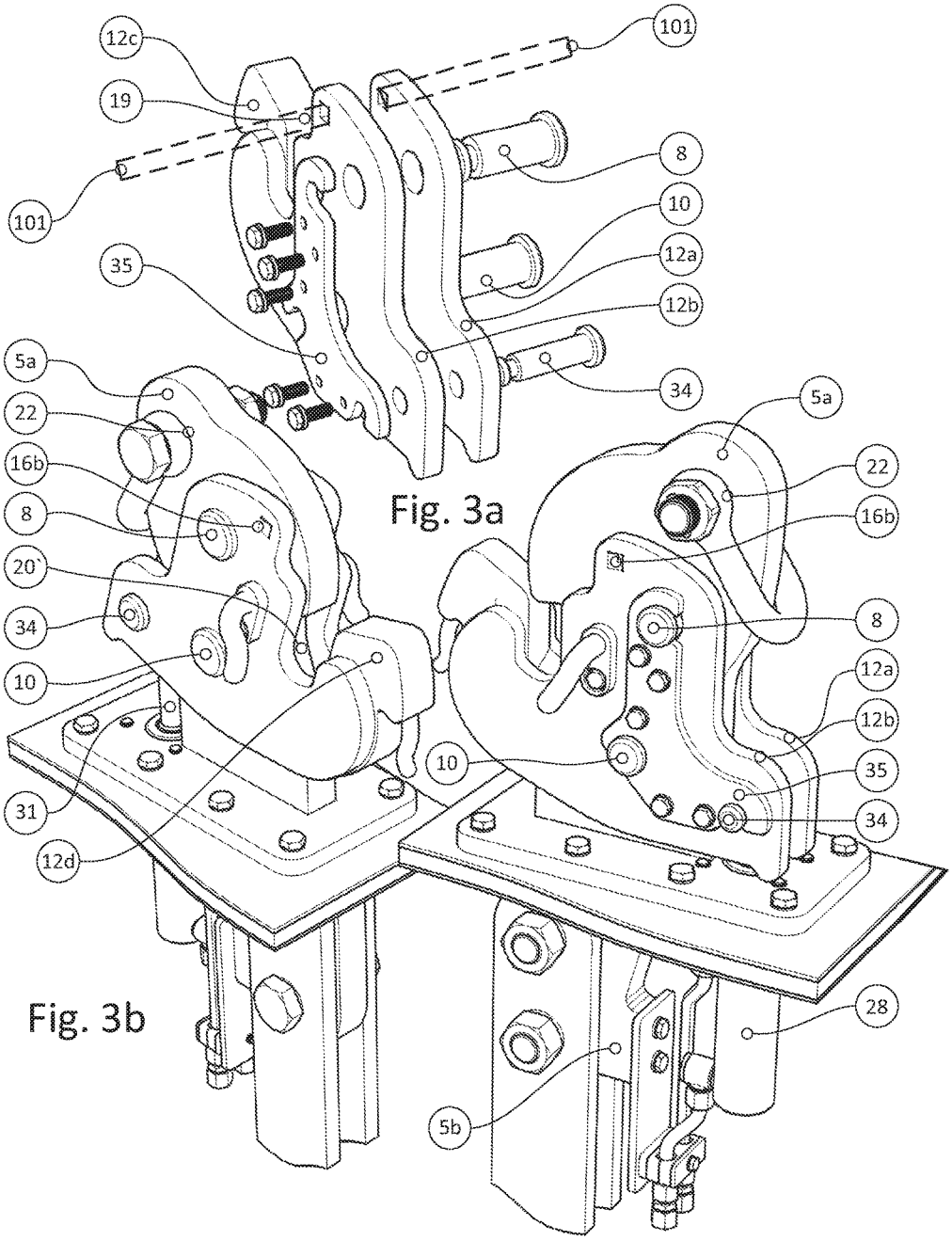

FIG. 3*a* shows an isometric view of the structure of the release mechanism.

FIG. 3*b* shows an isometric view of the hook in a released position.

FIG. 3*c* shows an isometric view of the hook in a secured position.

Figure 6:
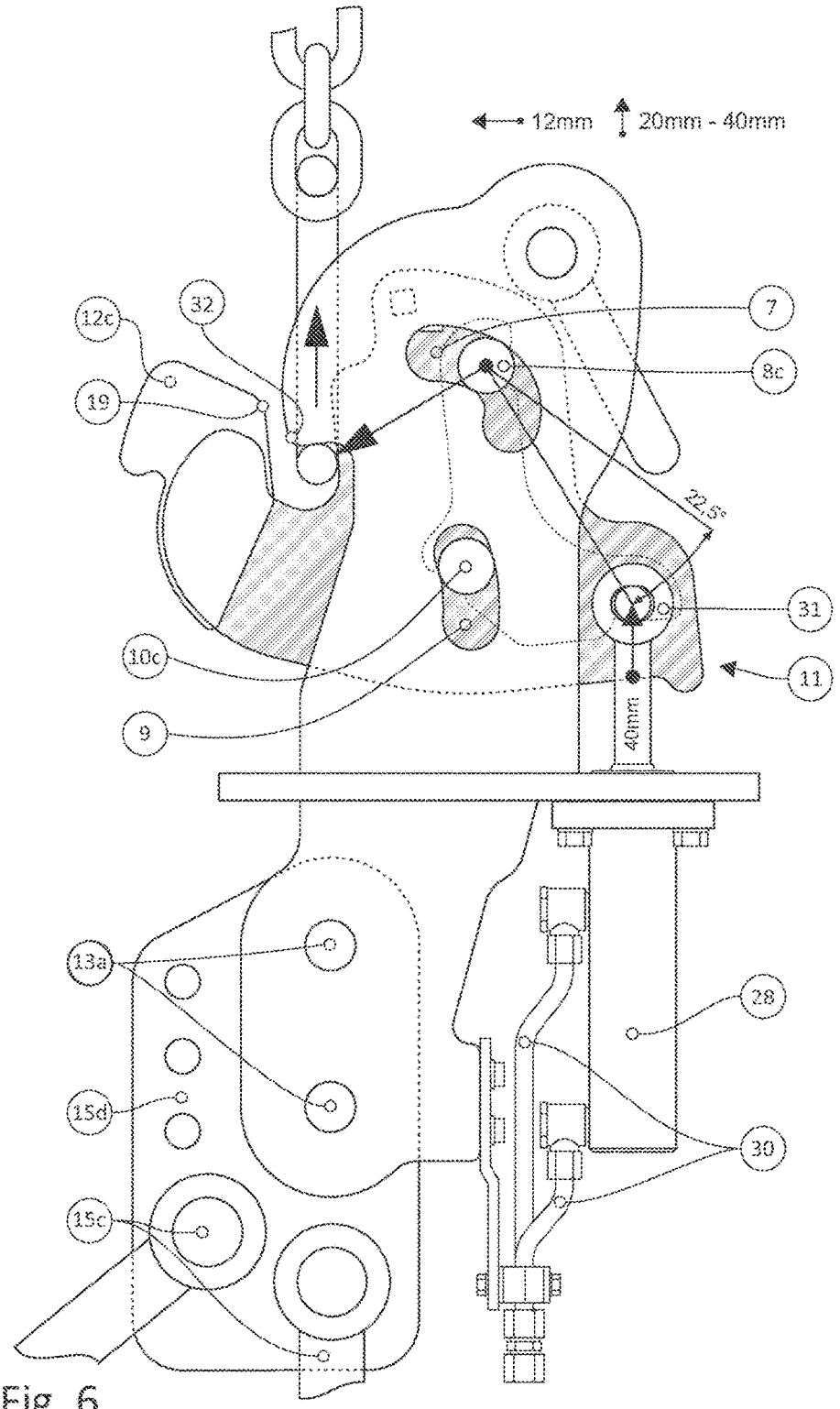
Figure 7:
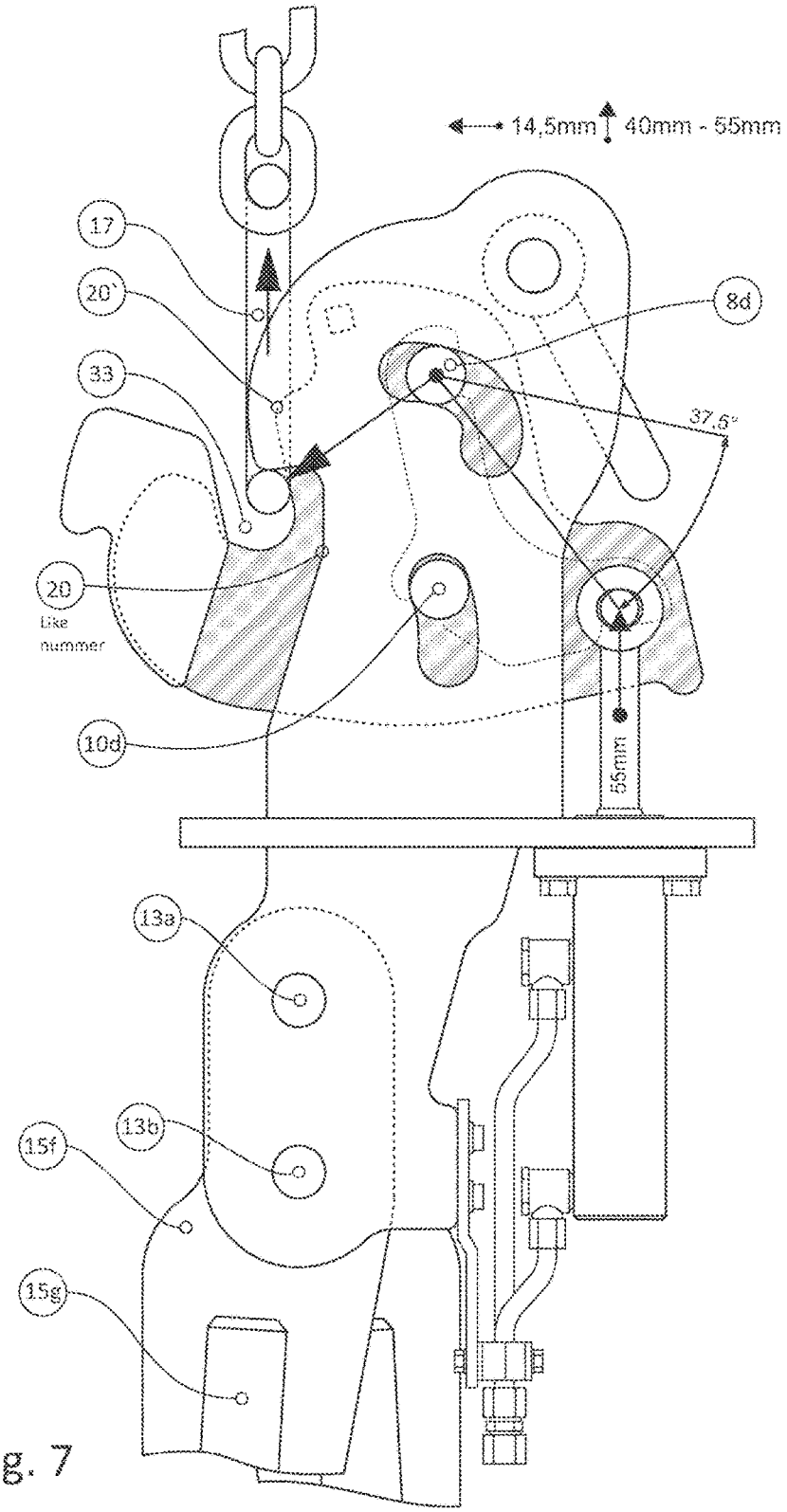
Figure 8:
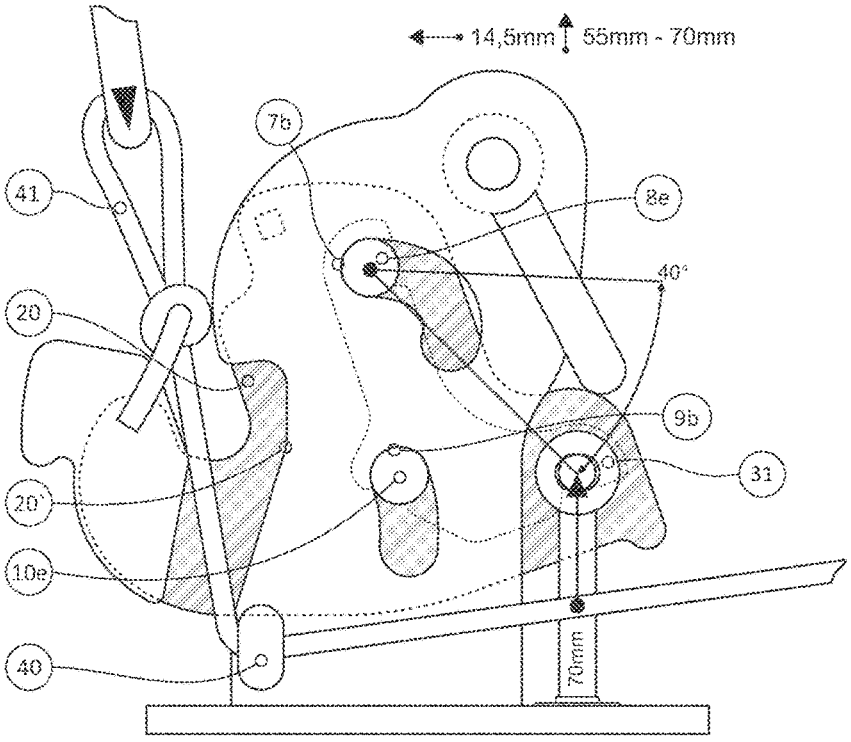
Figure 9:
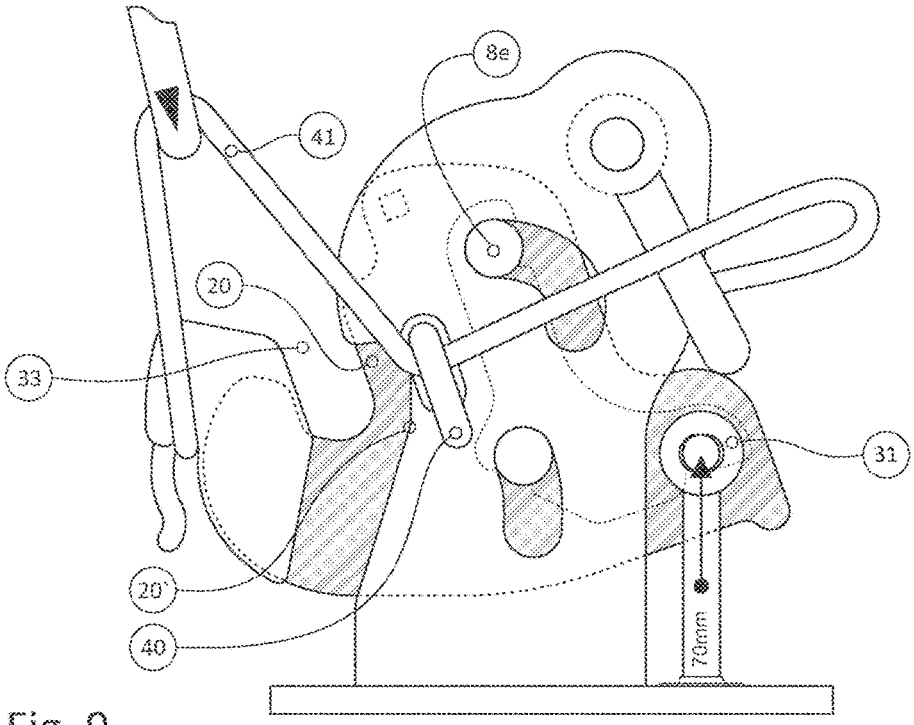

FIGS. 4-8 show the different steps of the guide pins from a closed securing position of the hook to an open release position, viewed schematically from the side, FIGS. 8-9 show the reverse handling of the lifeboat when the hook of the lifeboat is retrieved back to the fall, viewed from the side.

FIG. 10 shows the hook-shaped beak of the hook without the release mechanism, viewed from the side.

FIGS. 11*a*-*b* show the hook attached to the wires or chain in different directions viewed from the side.

Figure 12:
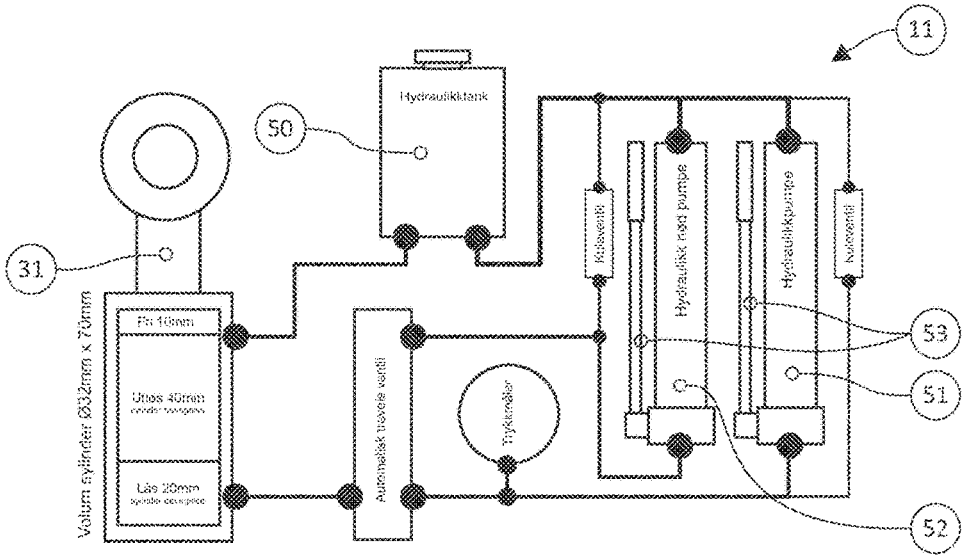

FIG. 12 shows schematically the hydraulic system for releasing the release mechanism in a free fall lifeboat with one hook.

Figure 13:
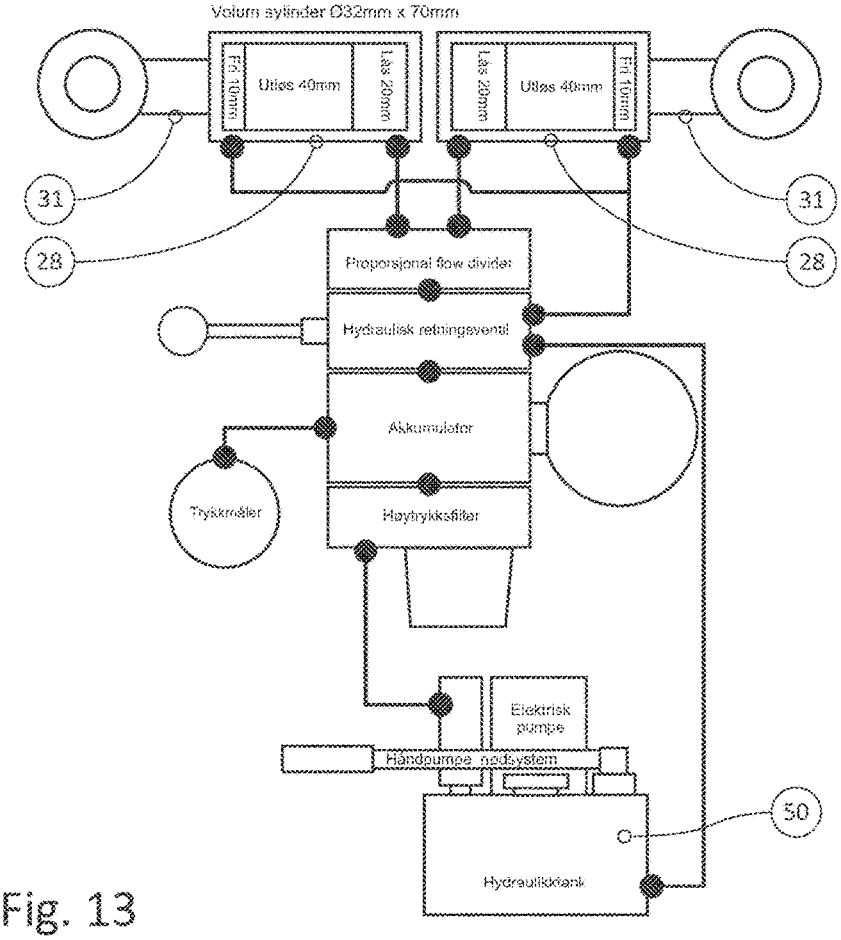

FIG. 13 shows schematically the hydraulic system for releasing the release mechanism in a conventional lifeboat arrangement with two hooks.

Figure 14:
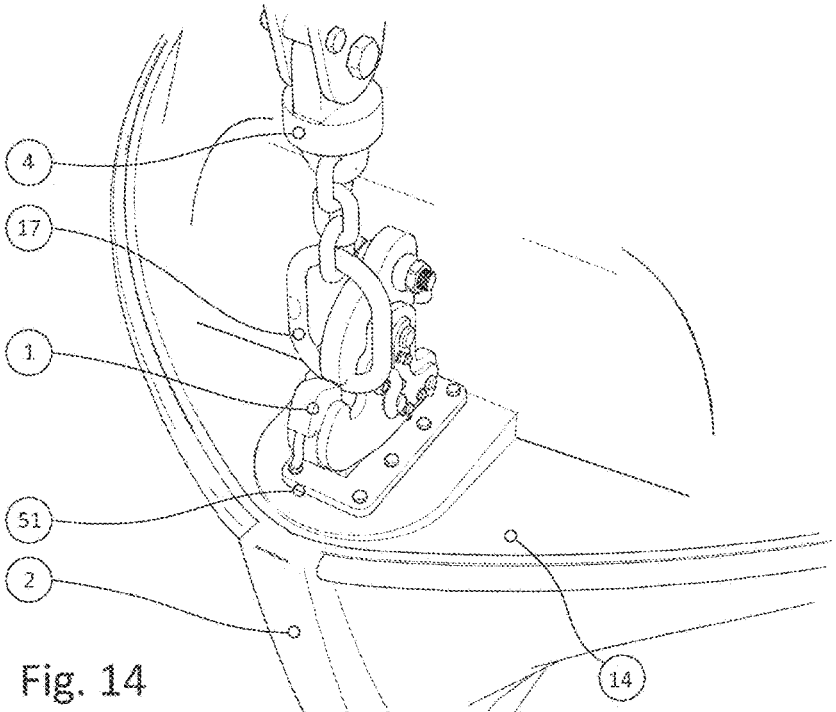

FIG. 14 shows an isometric view of the lifeboat hook attached to a lifting chain.

Figure 15:
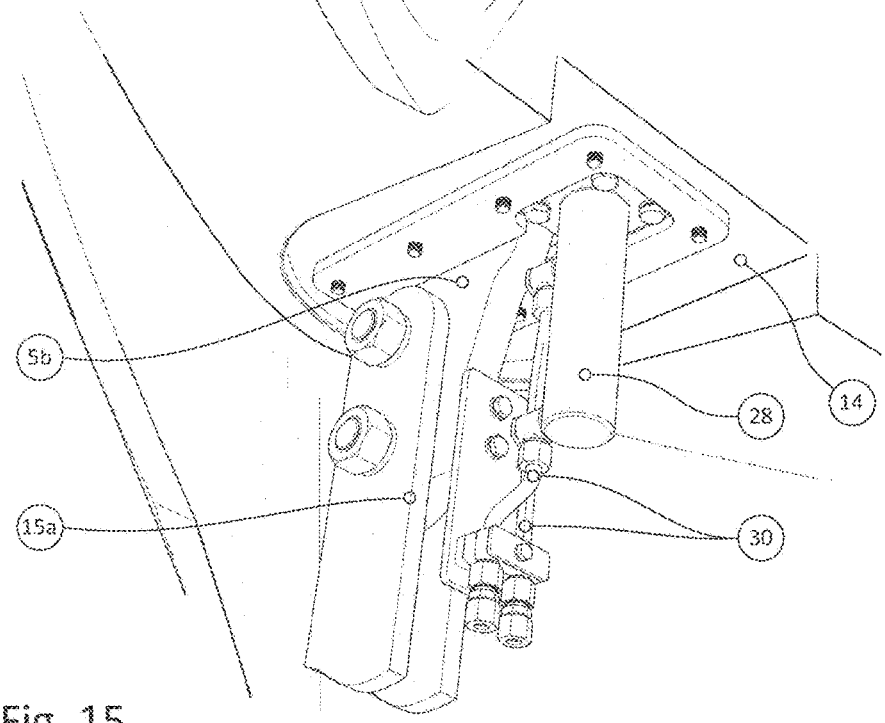

FIG. 15 shows an isometric view of the actuator system arranged beneath the lifeboat deck.

Figure 16A:
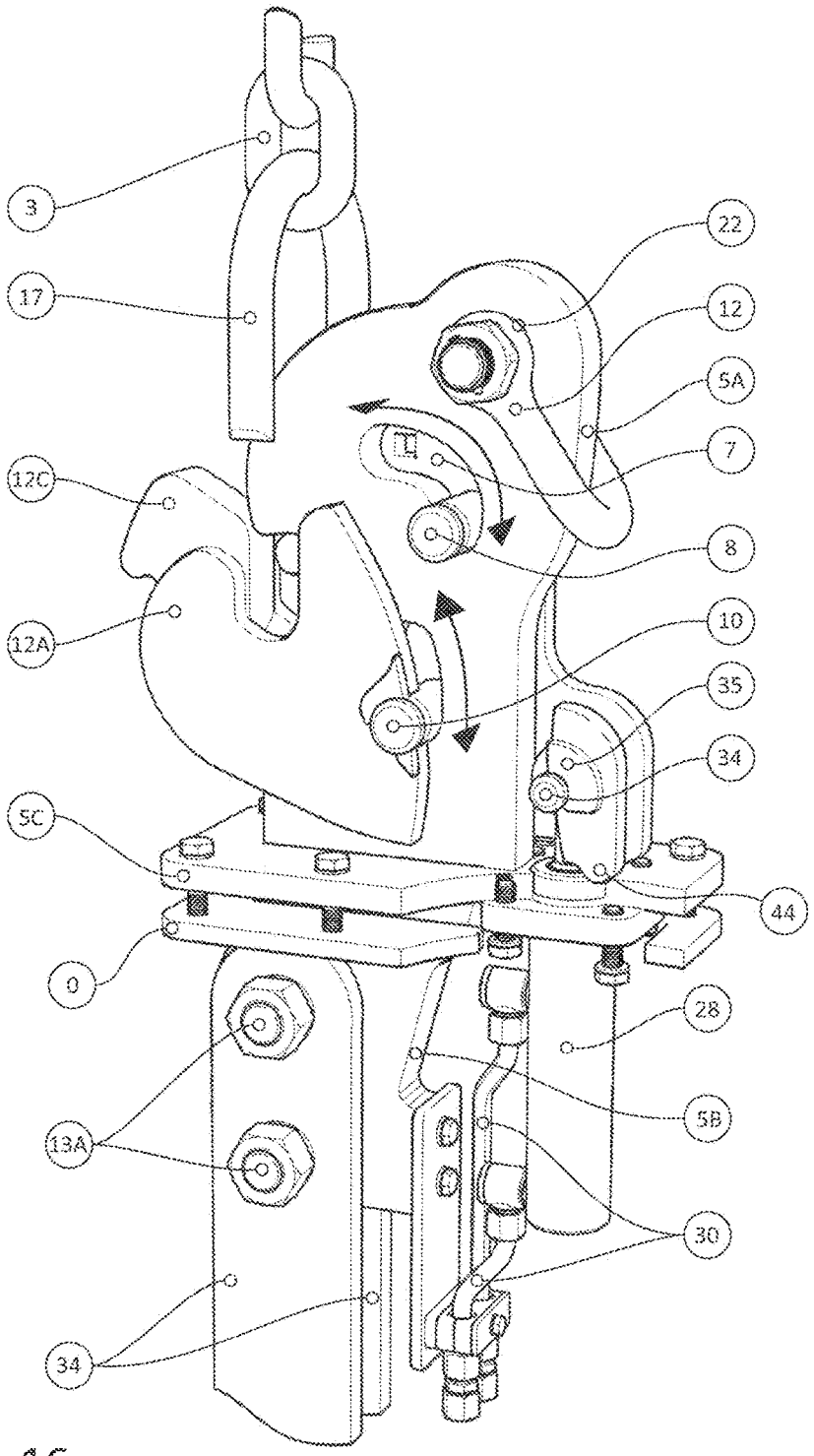
Figure 16B:
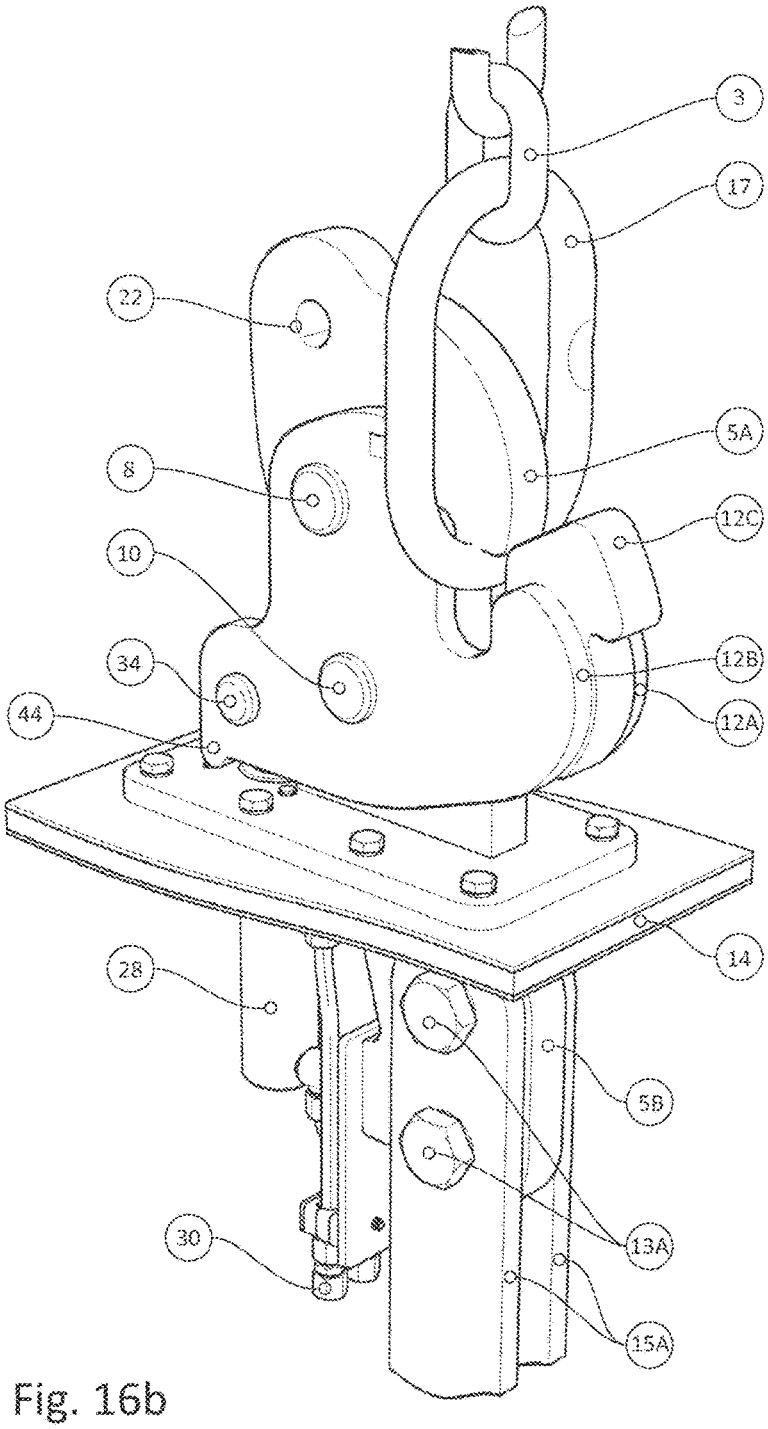

FIGS. 16*a* and 16*b* show an isometric view of the hook, viewed from both sides of the hook.

Figures 17, 18, 19:
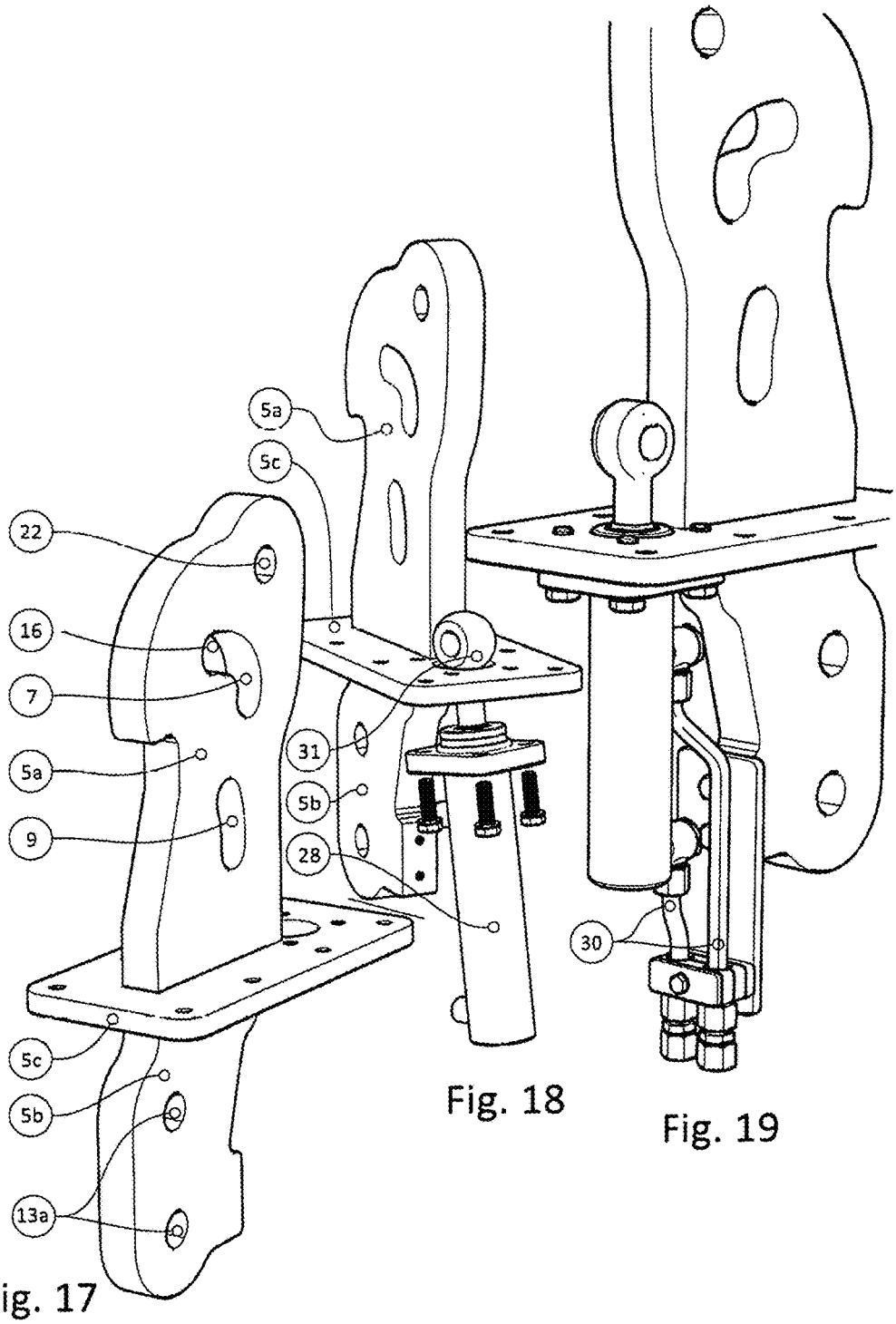

FIG. 17 shows an isometric view of the hook-shaped beak without the release mechanism.

FIGS. 18 and 19 show an isometric view of the piston arrangement in detail.

Figure 20:
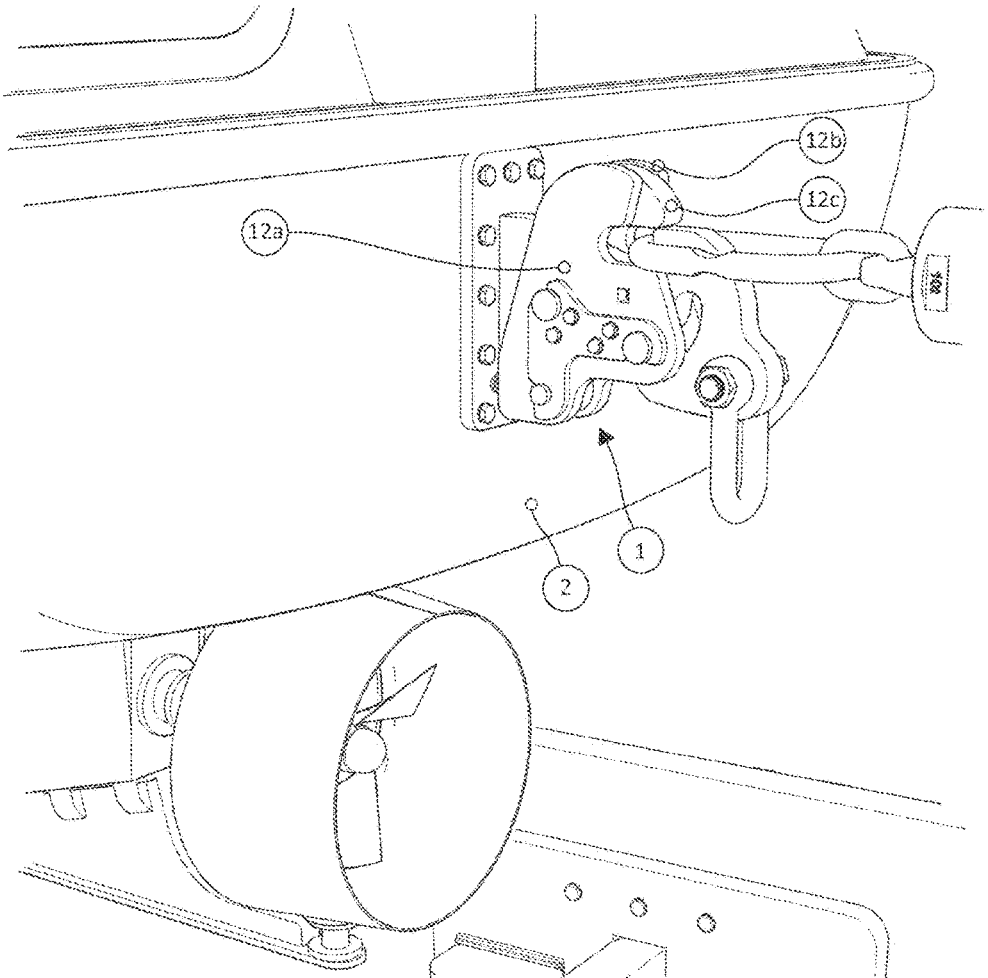

FIG. 20 shows an isometric view of a hook arranged on a freefall lifeboat.

Figure 21:
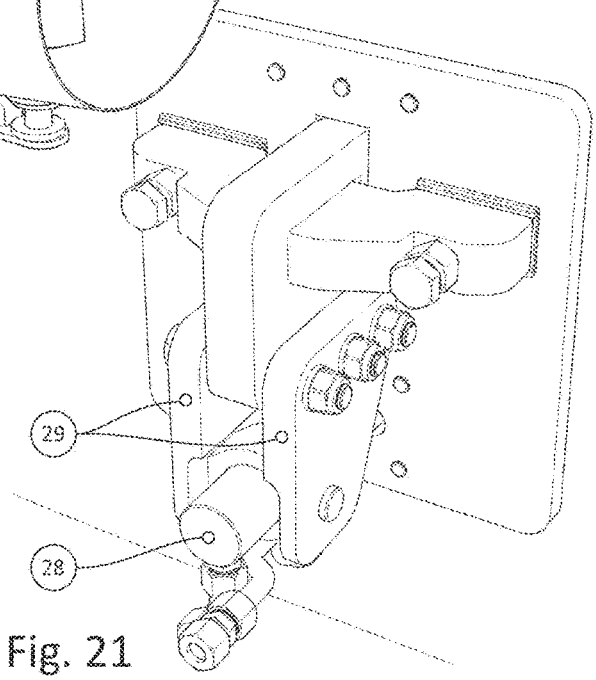

FIG. 21 shows an isometric view of the fastening arrangement of the hook in FIG. 20, viewed from the inside of the lifeboat deck.

Figures 22, 23:
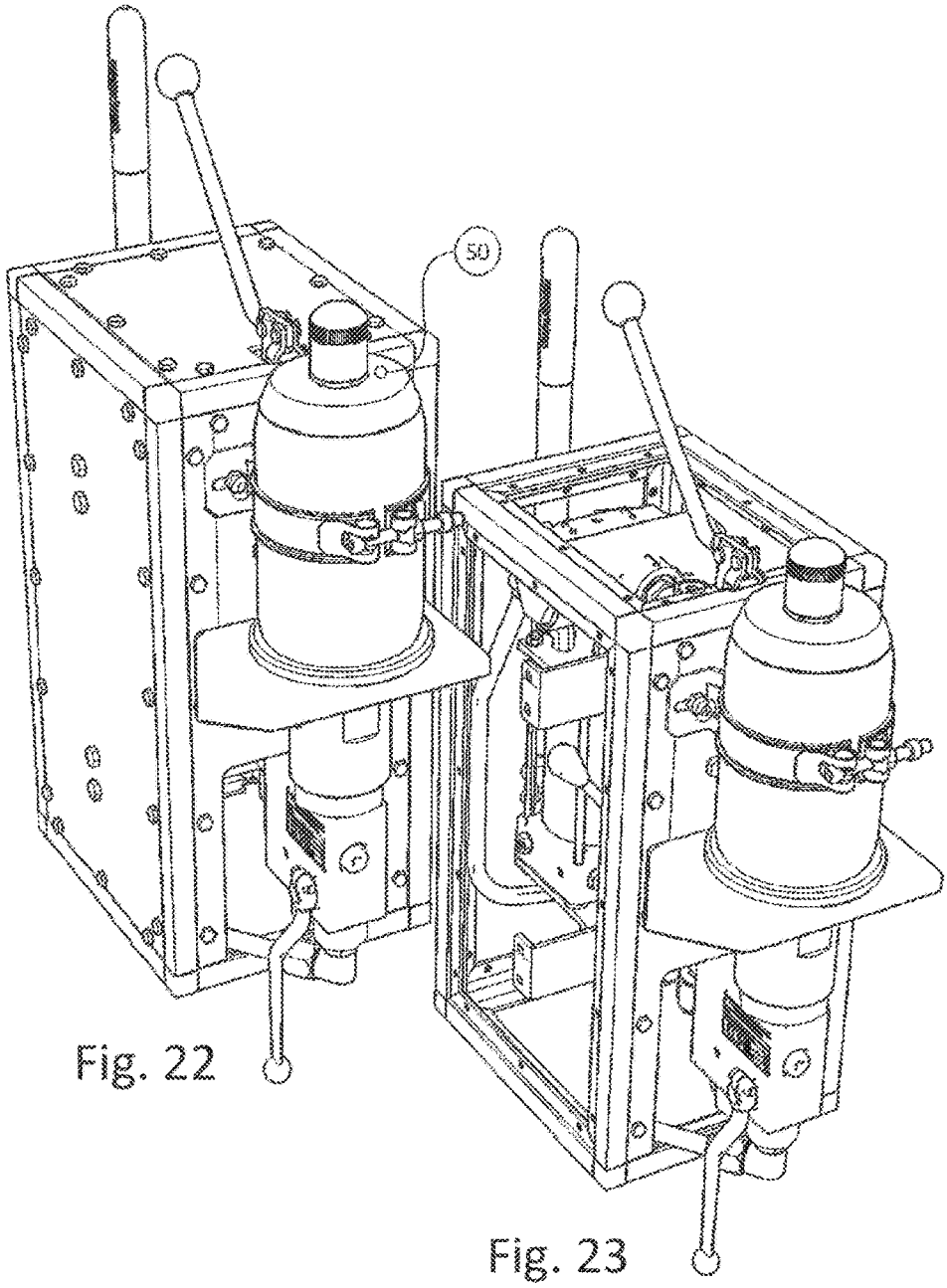

FIGS. 22-23 show an isometric view of the hydraulic arrangement connected to the piston arrangement.

Figure 24:
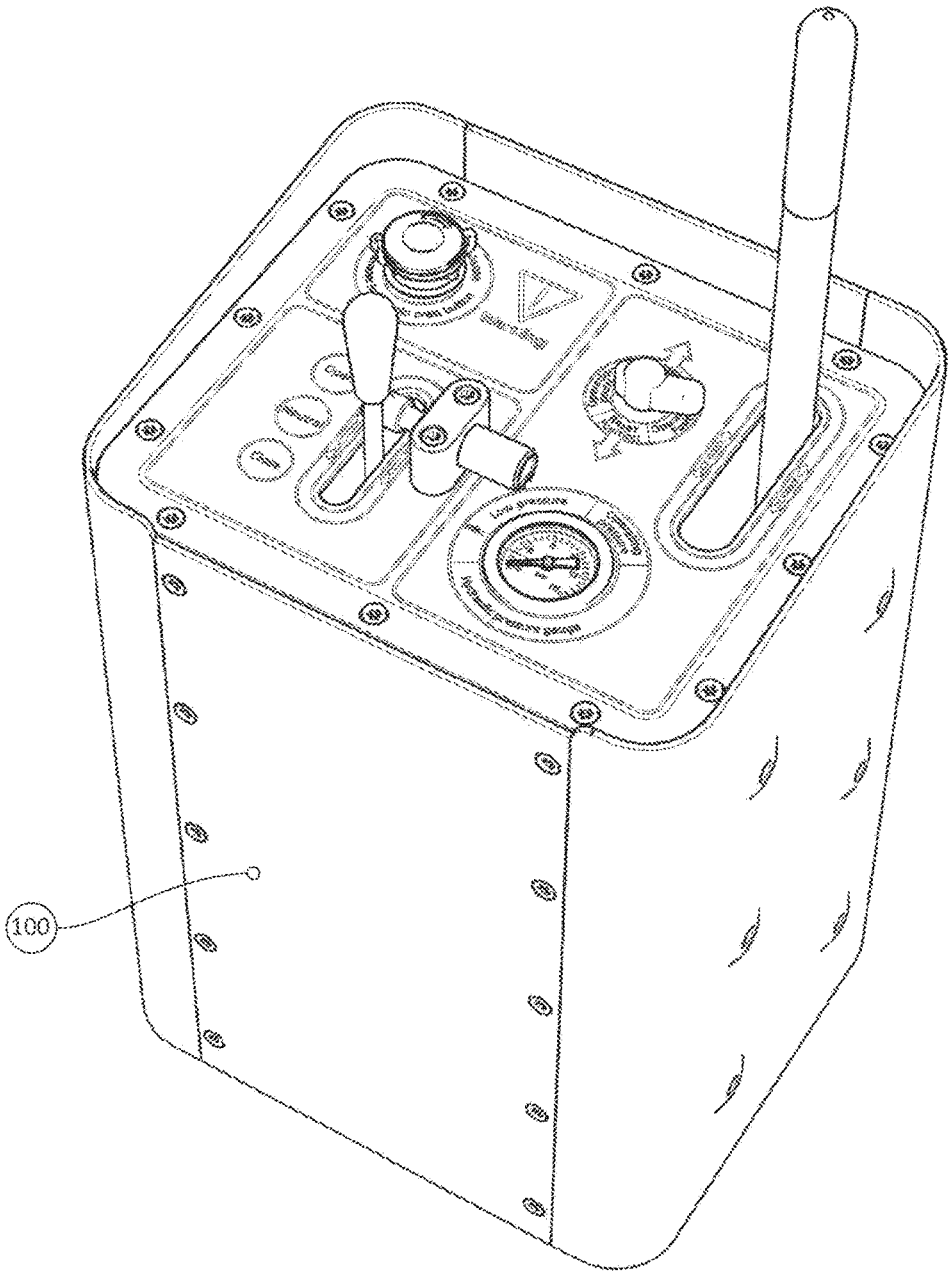

FIG. 24 shows a linear solenoid that could be used to operate the hook arrangement.

Figure 25:
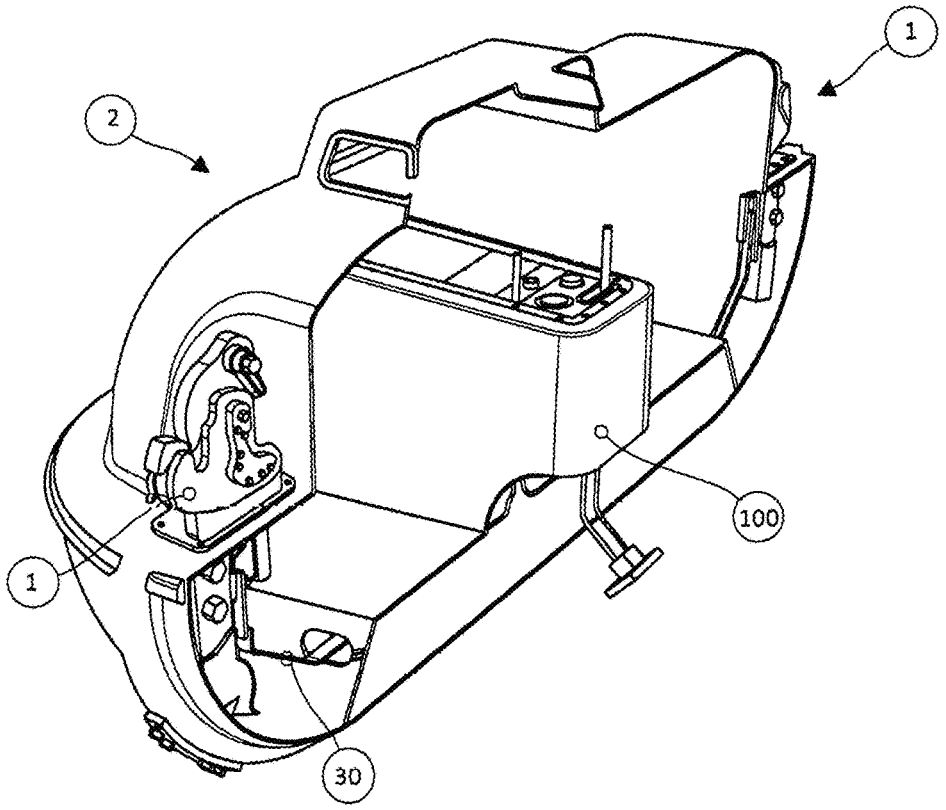

FIG. 25 shows lifeboat with the linear solenoid and the hook arrangements.

DETAILED DESCRIPTION

The term upper and lower in the description must be interpreted in the broadest sense and is defined in view of the orientation of the parts in the appended drawings. These parts could have other orientations than defined when the invention is in use.

Figure 2:
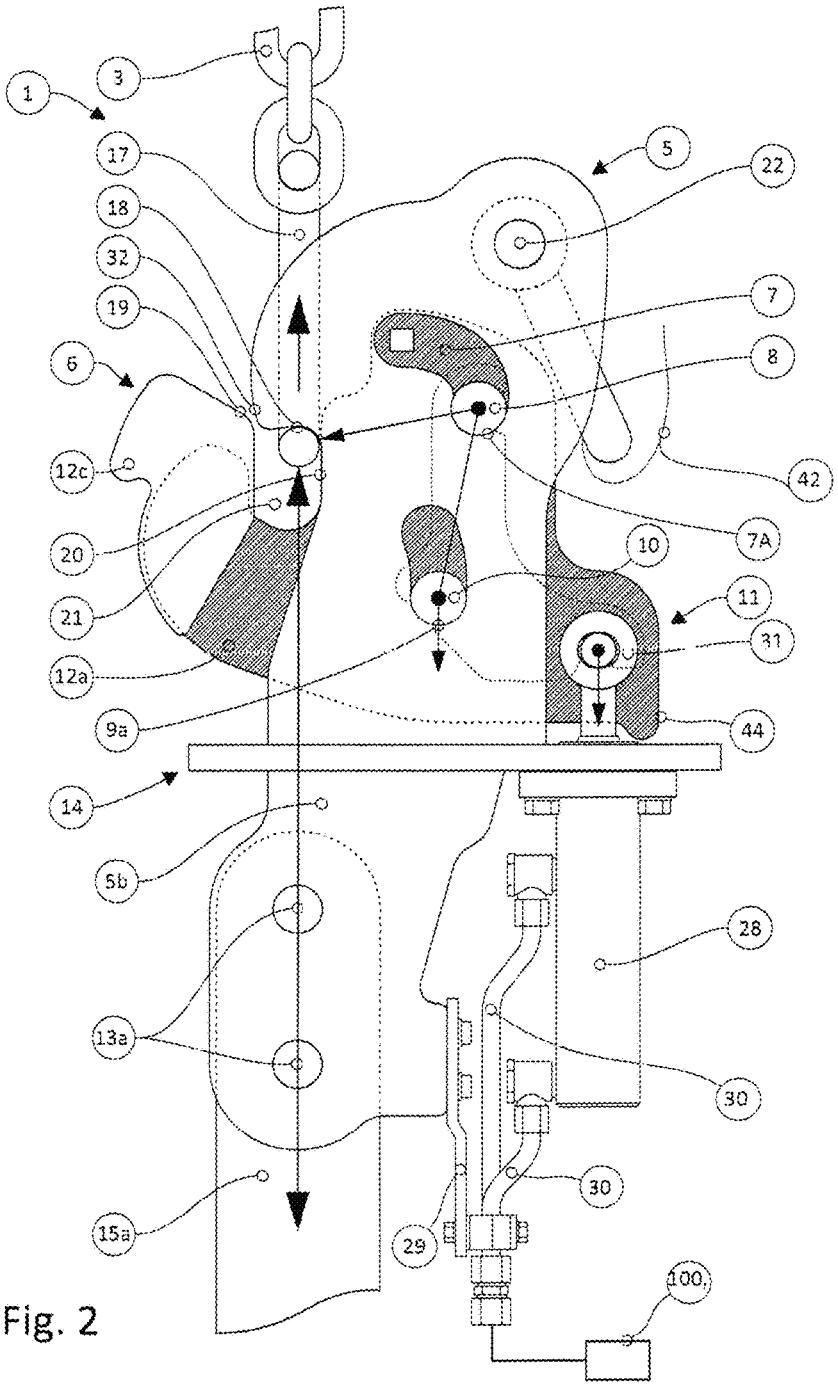
FIG. 2 shows the hook with release mechanism attached to the fall.

The main axis of the hook-arrangement is defined as a line extending from the first part of the hook-shaped beak 5*a* to the second part of the hook shaped beak 5*b*. This line is perpendicular to the lifeboat deck 14. In FIG. 2 this is a substantially vertical line.

Figure 1A:
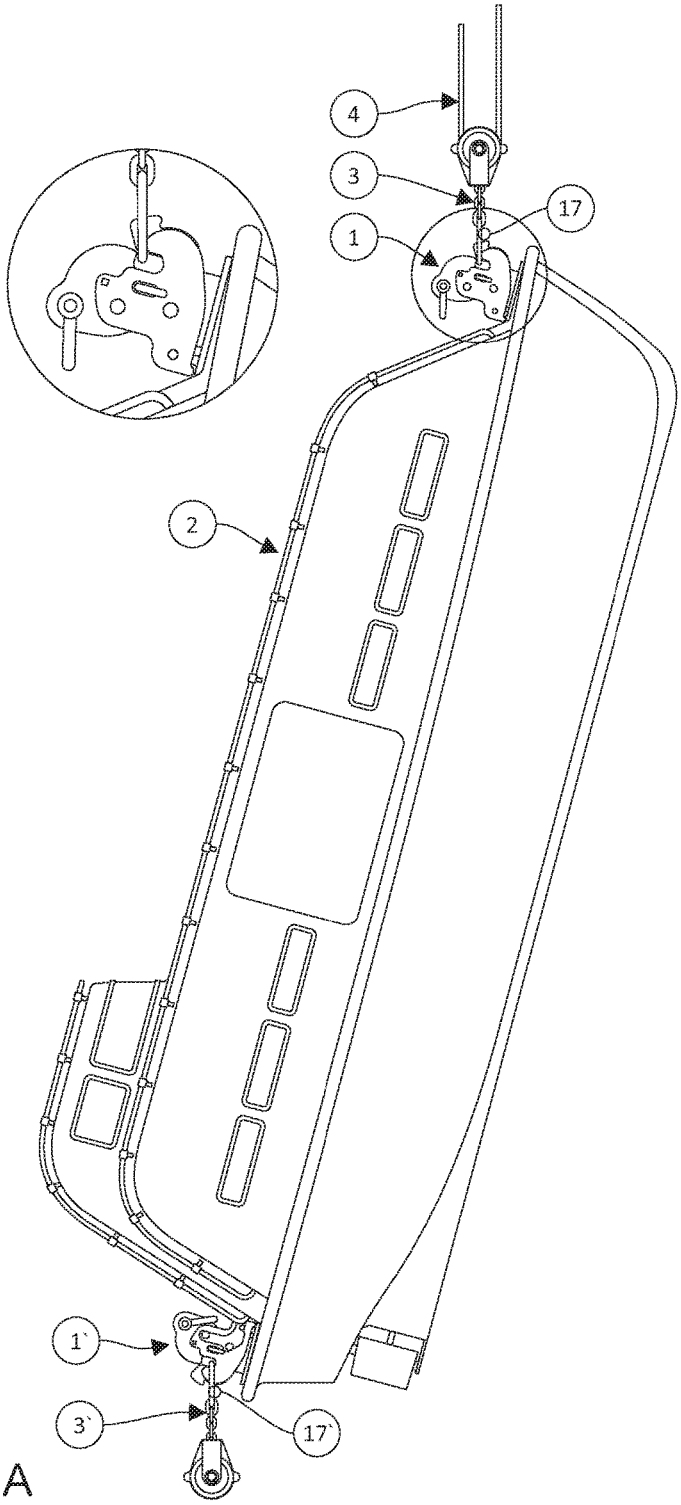
FIG. 1A is an overview of the lifeboat in emergency situations with a hook arrangement attached to a wire or cable for lowering the lifeboat.
Figure 1B:
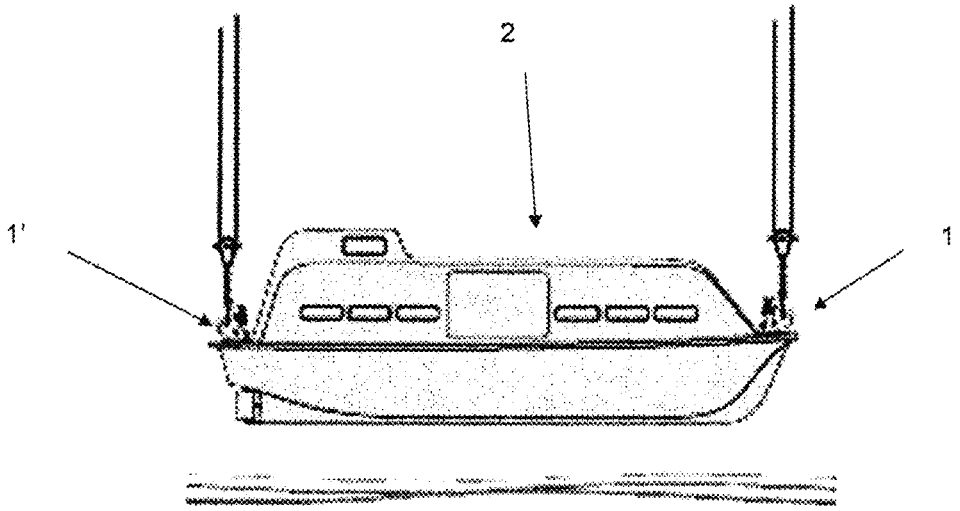
FIG. 1B is a side view of the lifeboat connected to a hook arrangement at a bow and a stern.
Figure 1C:
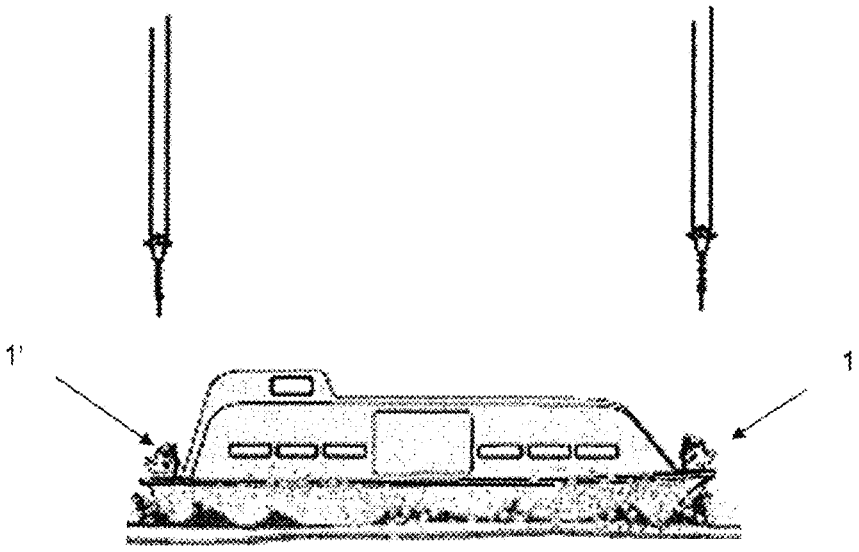
FIG. 1C is a side view of the lifeboat released from the hook arrangement at the bow and the stern.

FIG. 1A shows a lifeboat 2 suspended from a loop or chain link 17 attached to a lowering arrangement or fall, such as a davit and a tackle 4. One end of the tackle 4 is attached to a ship, platform or other devices that requires a lifeboat 2. At the other end there is arranged a chain assembly 3 with a loop, such as a chain link 17 at the free end. A wire or other arrangement suitable for securing the lifeboat 2 to the tackle 4 is also possible suspension arrangements. The chain link 17 is releasable connected to the lifeboat 2 through a hook assembly 1. The hook assembly 1 is attached to the lifeboat 2. There could be arranged only one hook arrangement 1 at the rear end of the lifeboat 2, if the lifeboat is a freefall lifeboat. As shown in FIGS. 1B-1C, there could also be arranged two similar hook arrangements 1, 1' at each of the front and rear end of the lifeboat 2. In special cases, also more than two hook arrangements are possible. Each of the hook arrangements 1, 1' are attached to separate sets of tackle 4 and chain 3 arrangement.

FIG. 1A shows a lifeboat 2 with two hook assemblies 1, 1'. The two hook assemblies may be arranged at each end of the lifeboat for simultaneous operation. The lifeboat is hanging from just one of the hooks 1, the other hook 1' is released from the chain link 17'.

The Figure shows an emergency position of the lifeboat where the lifeboat traditionally would have fallen into to the sea.

FIG. 2 shows the hook assembly 1 attached to the chain link 17 in detail. The hook assembly 1 comprises a hook-shaped beak 5 and a release mechanism 6.

A first part of the hook-shaped beak 5*a* is situated above a lifeboat deck 14; a second part of the hook-shaped beak 5*b* is situated below the lifeboat deck 14.

Both the first part of the hook shaped beak 5*a* and the second part of the hook shaped beak 5*b* are rigidly connected to the lifeboat 14.

The second or lower part of the hook-shaped beak 5*b* is attached to the lifeboat 2 through fixing means that are known per se. The second part of the hook-shaped beak 5*b* has two through holes 13*a* adapted to be connected to the fixing means 15 with bolts and nuts.

The fixing means could take many different shapes; some of the possible shapes are illustrated in FIGS. 2-9. In general, the upper part of the fixing means has openings 13*a* corresponding with the through holes 13*a* of the second part of the hook-shaped beak 5*b*.

In FIG. 2 the fixing means is a bar 15*a* with through holes 13*a* that is connected directly to the hook-shaped beak 5*b*.

Figure 4:
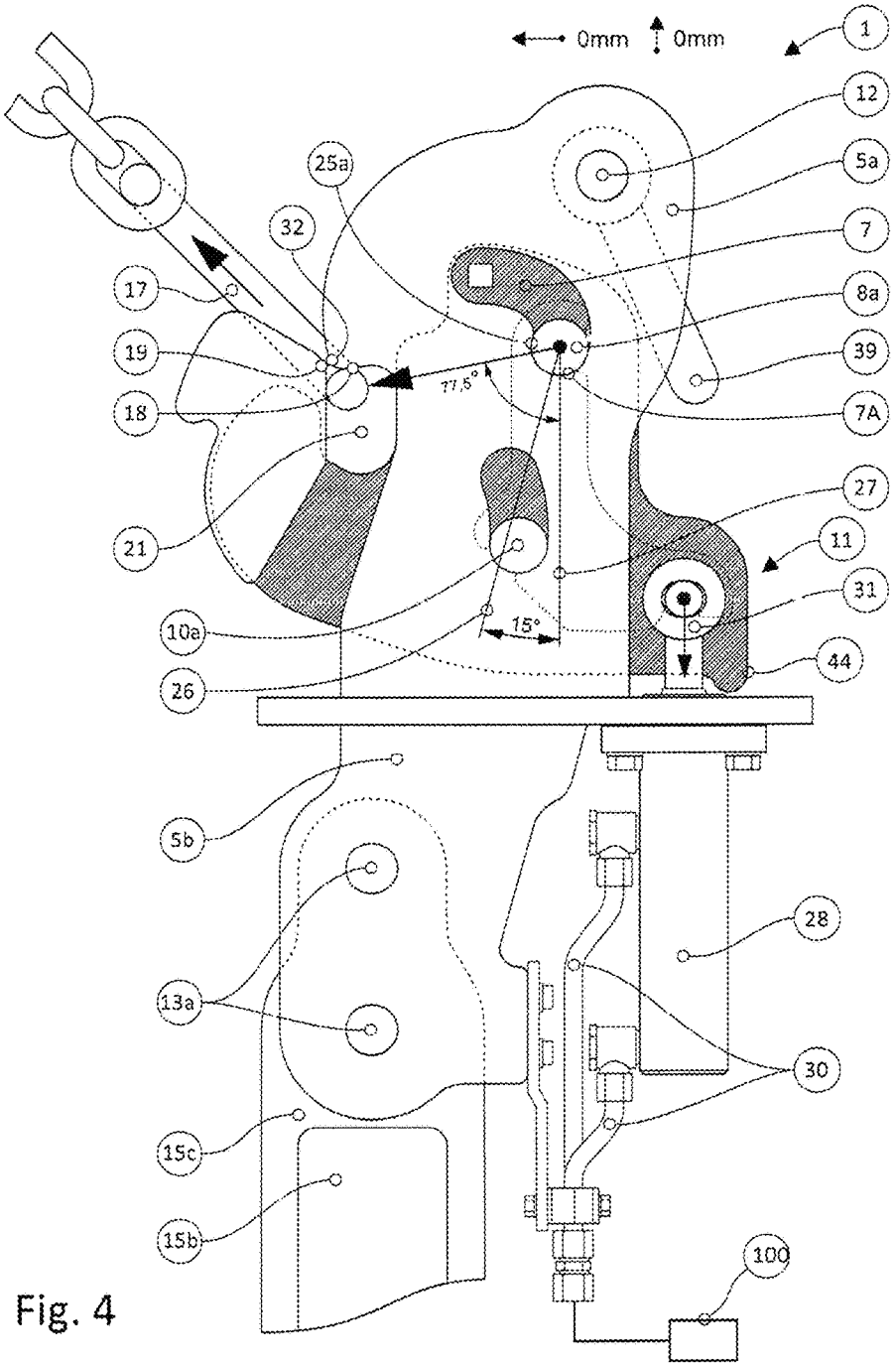
Figure 5:
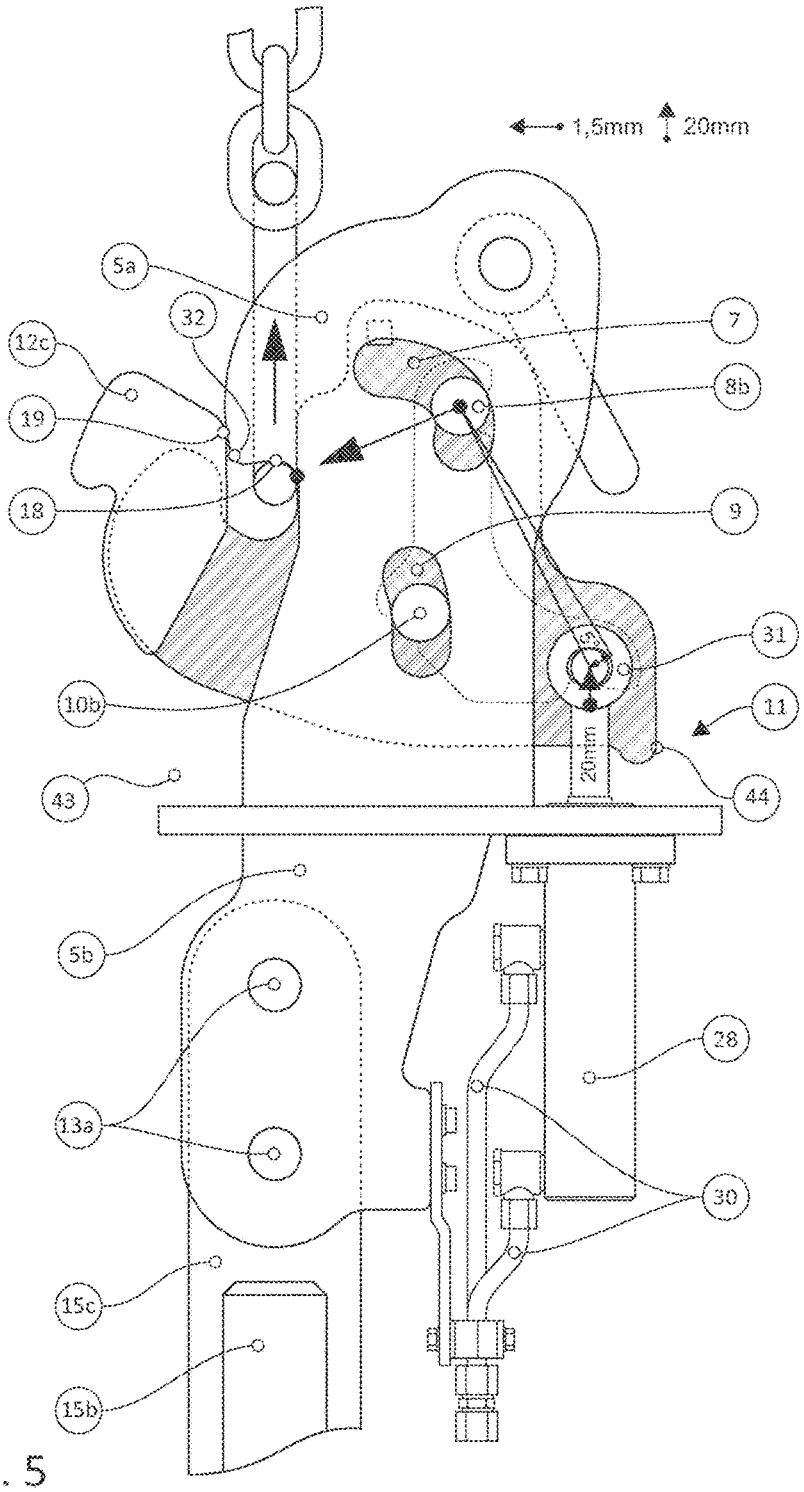

In FIGS. 4 and 5 the fixing means comprises a bar 15*b* connected to a bracket 15*c*. The bracket 15*c* has openings 13*a* that corresponds with the through holes 13*a* of the hook-shaped beak 5*b*.

In FIG. 6 the fixing means comprises of a bracket 15*d* and several bars 15*e* fixedly connected to the bracket 15*d*.

In FIG. 7 there are arranged two similar bars with brackets 15*f*, 15*g*. The brackets 15*f*, 15*g* have openings that correspond with the through holes 13*a* of the second part of the hook-shaped beak 5*b*, and are connected at each of the sides of the hook-shaped beak 5*b*.

The through holes 13*a* are vertically aligned with the chain link as the arrows in FIG. 2 indicates.

The first part of the hook shaped beak and the second part of the hook shaped beak are both coupled to the lifeboat deck 14 through fixing means known per se, for instance through bolts or similar as shown in FIGS. 3*b* and 3*c*.

FIGS. 2-7 show a cylinder 28 attached to the lifeboat deck 14. The cylinder 28 could be supported by a bracket arranged between the cylinder 28 and the second part of the hook shaped beak 5*b* to support the cylinder (not shown) or a bracket 29 arranged between the hook shaped beak 5*b* and conduits 30 supplying hydraulic fluids to the cylinder 28. This embodiment is illustrated in the drawings. The cylinder 28 is in this embodiment fixedly attached to the lifeboat 2.

The cylinder 28 is a part of a hydraulic piston arrangement 11 or actuator. There is arranged a piston 31 within the cylinder 28, the piston 31 is adapted to move within the cylinder 28 depending on the amount of hydraulic fluid forced into the cylinder 28. The piston 31 is attached to the release mechanism 6 as shown in FIG. 2. The movement of the piston 31 leads therefore to a movement of the release mechanism 6.

The hydraulic cylinder is fixed to the release mechanism and have a possibility of 1 mm lateral movement in the fixings of the piston rod to the release mechanism. This prevents strain on the piston rod. The clearance is illustrated in FIG. 2.

Other power transmission arrangements suitable for the arrangement are also possible instead of the hydraulic piston arrangement 11. It is for instance possible to use a wire or similar to push the release mechanism to the release position.

There are shown two conduits 30 in the FIG. 2 to supply a hydraulic fluid into the cylinder 28 and also the return of the hydraulic fluid from the cylinder 28.

FIG. 2 shows the first part of the hook-shaped beak 5*a*, with a shoulder 18 arranged on the hook-shaped beak 5*a*. The shoulder 18 has horizontal, gently sloping length, which ends in a tip 32. The shoulder 18 has a length that is larger than the cross-sectional diameter of the chain link 17. The shoulder 18 is arranged so that it makes it possible for the hook-shaped beak 5*a*, 5*b* to hang from the chain link 17 without any devices securing the chain link 17 (provided the hook-shaped beak is oriented substantially vertical). In order to obtain this, the chain link 17 must be arranged resting only on the shoulder 18, as shown in FIG. 2, not both on the shoulder 18 and the release mechanism 6 as shown in FIG. 4. In FIG. 4 the lifeboat 2 would drop if the release mechanism is moved away from the shoulder tip 32.

The release mechanism 6 having a wedge 12*c* enclosing the chain link 17 when the hook arrangement is in a closed position. A tip of the wedge 19 is in this position close to the shoulder tip 32 of the beak 5.

FIGS. 2 and 4 show the different hanging positions of the hook 1 relative to the chain link 17.

FIG. 2 shows a hanging position where only the shoulder 18 is in contact with the chain link 17, and there is no strain on the wedge 12*c*.

FIG. 4 shows another possible position of the hook 1 and chain link 17. In this position, the hook 1 has been pivoted relative to the chain link 17, and the chain link 17 is arranged on the tip of the shoulder 32. The small distance between the tip of the wedge 19 and the tip of the shoulder 32 secures the chain link 17 within the cavity of the hook 1.

The FIG. 2 also shows slots 7 and 9. A first guide slot 7 and a second guide slot 9 are arranged on the first part of the hook-shaped beak 5*a*, the first guide slot 7 is situated above the second guide slot 9 at a distance spaced apart from the second guide slot 9.

In addition to the guide slots 7, 9 there could be arranged a first safety bore 22 at the top or near the top of the first part of the hook-shaped beak 5*a* and a second safety bore mechanism 16*a*, 16*b* between the guide slots 7, 9 on the first part of the hook-shaped beak 5*a*. The first safety bore 22 is adapted to receive a shackle 39 or similar arrangement and could be used as a safety device during maintenance of the hook 1. This is further described in relation to FIG. 9.

The second safety bore mechanism 16*a*, 16*b* is adapted to receive a pin or a suitable tool (not shown) acting as a fuse for manually preventing movement of the release mechanism 6.

The release mechanism 6 shown in FIG. 2 is further described with reference to FIGS. 3*a*-*c*. The release mechanism 6 is designed with two parallel plates 12*a*, 12*b*. The plates 12*a*, 12*b* are arranged one on each side of the first part of the hook-shaped beak 5*a* and are provided with guide pins 8, 10. These guide pins 8, 10 extends between the plates 12*a*, 12*b* and are adapted to engage the guide slots 7, 9 in the beak. The guide pins 8, 10 are adapted to move within the guide slots 7, 9. A first guide pin 8 is adapted to move within the first guide slot 7, a second guide pin 10 is adapted to move within the second guide slot 9.

An opposite arrangement is also possible, where the slots are arranged on each of the plates 12*a*, 12*b*. The guide pins could in this embodiment extend from the first part of the hook-shaped beak 5*a* at both sides (not shown).

A piston connector 34 is arranged between the plates 12*a*, 12*b* at the lower part of the plates 12*a*, 12*b* and is adapted to engage with the piston 31.

The guide pins 8, 10 and the piston connector 34 are connected to a guide pin bracket 35 arranged on the outside of one of the release plates 12*a*, 12*b* as shown in FIG. 3*a*. This guide pin bracket 35 secures the guide pins and the piston connector 34 in the arrangement. The bracket is adapted to engage with grooves in the guide pins to secure the guide pins and the piston connector 34.

The second safety bore mechanism 16*a*, 16*b* comprising a plate safety bore 16*b* at each of the plates 12*a*, 12*b*. These plate safety bores 16*b* are adapted to correspond with a beak safety bore 16*a* on the hook-shaped beak 5. These second safety bore mechanism 16*a*, 16*b* are adapted to receive a cotter bolt or similar pin to manually prevent movement of the release mechanism 6 in relation to the beak 5.

It is also possible to place sticks or levers 101 into each of the plate safety bores 16*b* and manually rotate the release mechanism 6.

FIGS. 3*a*-3*c* also show the wedge 12*c* arranged between the two plates 12*a*, 12*b*. The wedge 12*c* is situated as an extension of the outer leg in a U-shaped part 12*d* of the release mechanism 6. The inner leg is defined as an edge 20'. A tip 19 of the wedge 12*c* is adapted to be arranged near the tip 32 of the shoulder 18 when the hook 1 is in the locked position. The locked position is shown in FIG. 3*c*. The position is also schematically shown in FIGS. 2 and 3. In this position the chain link 17 is secured within a cavity 21 defined by the U-shaped part of the release mechanism 6 and the shoulder 18.

A releasing position of the hook 1 is shown in FIG. 3*b*. In this position, the wedge tip 19 is moved a distance away from the shoulder tip 18. This position is also schematically shown in FIGS. 8 and 9.

The actuator or hydraulic piston arrangement 11 is arranged on the opposite side of the release mechanism 6 from the wedge 12*c*. The piston 31 is connected to the release mechanism through the piston connector 34.

FIG. 2 shows the hook in the locked position as described earlier. The first guide pin 8 is in this position defined to have a position 8*a* arranged in the first end 7*a* of the guide slot 7. The second guide pin 10 is defined to have a position 10*a* in the first end 9*a* of the second guide slot 9. In this locked position the inner wall 20 of the hook-shaped beak 5 is congruent with the edge 20' at the inner side of the cavity 21.

FIGS. 2 and 4 show the hook arrangement in the locked position where the chain link is held in a secured position within the hook arrangement 1.

FIGS. 5, 6 and 7 show a first, a second and a third intermediate position between the locked position and the releasing position of the hook arrangement 1.

To achieve these positions the actuator or piston arrangement 11 will force the release mechanism 6 towards a released position. In each of this positions, the guide pins 8, 10 are moved from the first end 7*a*, 9*a* of the guide slots 7, 9 (shown in FIGS. 2 and 4) towards a second end 7*b*, 9*b* of the guide slots (shown in FIG. 8). The wedge 12*c* is moved down and away from the shoulder tip 32 through these position. In the first intermediate position, the guide pins 8, 10 have the positions 8*b*, 10*b* in the guide slots 7, 9 as shown in FIG. 5.

In the second intermediate position, the guide pins 8, 10 have the positions 8*c*, 10*c* in the guide slots 7, 9 as shown in FIG. 6.

In the third intermediate position, the guide pins 8, 10 have the positions 8*d*, 10*d* in the guide slots as shown in FIG. 7.

FIGS. 8 and 9 show the hook 1 in the released position. In this position the first guide pin 8 is arranged at the second end of the guide slot 7*b* in a position defined as 8*e*. The second guide pin 10 is arranged at the second end of the second guide slot 9*b* in a position defined as 10*e*.

In the released position, there is a gap 33 from the shoulder tip 32 to the tip of the wedge 19. The gap 33 is larger than the chain link 17 so that the chain link 17 can escape from the hook arrangement 1.

When the release mechanism 6 rotates towards the released position, the edge 20' at the inside of the U-shaped part of the release mechanism 6 moves towards the shoulder tip 32. The edge 20' pushes the chain link 17 towards the shoulder tip 32 and thereby releases the hook arrangement and thus the lifeboat 2 from the chain link 17.

The FIGS. 2-9 show that the hook-shaped beak 5 has the same position in all figures. It is the movement of the release mechanism 6 that causes the different positions of the hook 1.

The hydraulic piston 31 applies a vertical force on the end or beneath the release mechanism 6. The release mechanism 6 is then forced by the actuator or piston arrangement to move a distance. The guide pins 8, 10 are forced to move along the geometry of the guide slots 7, 9 so that the movement of the release mechanism is rotary like.

This is shown in FIGS. 5, 6 and 7 as the first, second and third intermediate positions 8*b*, 8*c*, 8*d* of the guide pin 8, between the locked position 8*a* and the releasing position 8*e*. The first guide slot 7 has a curved shape, for instance as shown in the FIG. 4-8.

As shown in FIG. 4 there is an undercut at the end 7*a* of the first guide slot 7.

A tangential line 26 in the upper contact point 25*a* between the first guide slot 7 and the first guide pin 8, has in this position a negative angle in relation to a vertical line through the same contact point 25*a*. When the first guide pin 8 is moved within the first guide slot 7 the angle between the vertical line and the tangential line is decreasing until the angle is zero in a position between the locked position 8*a* and the first intermediate position 8*b*. The angle will increase in the positions after this. This means that the force has to be largest in the beginning to force the first guide pin 8 out of the locked position 8*a* until the defined angle is zero.

The movements of the first guide 8 in the vertical and horizontal directions are illustrated in the FIGS. 5-8. From the locked position 8*a* to the first intermediate position 8*b*, the first guide pin 8 and the piston 31 is moved a distance approximately 20 mm in the vertical direction, but the displacement is only approximately 1.5 mm in the horizontal direction.

From the first intermediate position 8*b* to the second intermediate position 8*c*, the first guide pin 8 is moved a distance approximately 20 mm in the vertical direction and the displacement is approximately 12-13 mm in the horizontal direction.

From the second intermediate position 8*c* to third intermediate position 8*d*, the piston 31 and the first guide pin 8 is moved a distance approximately 20 mm in the vertical direction and a further displacement of approximately 14, 5 mm in the horizontal direction.

From the third position 8*d* to the releasing position 8*e*, the first guide pin 8 and the piston 31 is moved a distance 8 mm in the vertical direction and a further displacement of approximately 14.5 mm in the horizontal direction.

In this embodiment the movement from 0-40 mm of the piston rod 31 in the vertical direction the chain link 17 is secured in the hook arrangement 1.

The movement of the piston rod 31 from 40-55 mm in the vertical direction is defined as a release phase. When the piston rod has moved from 55 mm to 70 mm the hook arrangement is in open and the chain link is released from the hook arrangement 1.

The displacements lengths above are just illustrative examples of how the horizontal displacement increases towards the releasing position and that the force is large in the beginning and is decreasing towards the released position. The displacement in the horizontal direction is small in the beginning but increasing towards the released position.

Other shapes of the first guide 7 slot or the second guide slot 9 and actuator arrangements will give other displacements in the horizontal and vertical direction.

The second guide pin 10 correspondently moves along the second guide slot 9 from the secured position 10*a* through the first, second and third positions 10*b*, 10*c*, 10*d* to the releasing position 10*e*. The different positions are shown in FIGS. 4-8.

The second slot 9 is shaped as an elongated substantially vertical slot and slightly curved at a second end 9*b* facing the first guide slot 8. When the actuator 11 is moving the release mechanism 6 upwards, the second guide pin 10 tends to move in the same direction as the actuator 11 but is forced to move along the surface of the second guide slot 9.

After the lifeboat has been released from the chain link 17, the reversed operation can be performed to retrieve the chain link 17 in the hook 1 and lift the lifeboat 2 back to the initial position.

This operation is shown in FIGS. 8 and 9. A rope or wire 41 could be attached to the chain link 17 as an assistance rope. The rope 41 extends via a pin 40 to a mechanism (not shown) that is pulling the rope 41 until the chain link 17 is positioned within the cavity 21. The mechanism could be mechanical or electrical or just hand force to pull the chain 3 back towards the hook arrangement 1.

The rope or wire is preferably arranged in the hook arrangement and the chain link before the lifeboat is released to obtain an easy retrieval of the lifeboat.

The wire or rope could also act as a coupling between the mother ship and the lifeboat after the lifeboat has been released.

The rope 41 could be arranged in different ways between the chain link 17 and the hook 1. The rope 41 could be arranged in a multiple different ways to the hook arrangement like tied with a knot directly to the chain link 17 as shown in FIG. 8 or attached to a pin 40 on one side of the hook 1, the rope 41 extends in this case through the chain link 17 and back to a pin (not shown) arranged on the opposite side of the hook 1. The pins 40 could be attached to the beak 5, the release mechanism and arranged on a bow shaped device arranged on the outside of the wedge 12*c* (not shown). This prevents accidents like crushing when the chain link 3 is moved back into the cavity 21 as well as it helps guiding the chain link 21 into a suitable position towards the cavity 21.

FIG. 10 shows a maintenance position where the release mechanism 6 and the actuator are removed. In this position, there is no securing of the chain link 17 and it is possible that the chain link 17 could slip from the shoulder 18. To prevent the lifeboat from falling, there is arranged a wire 42, also referred to as a securing element, between the ship and the shackle 15.

FIG. 11*a* and FIG. 11*b* show an example of different hanging positions of the lifeboat with hook arrangement 1. In FIG. 11*a* the shoulder 18 and release mechanism 6 is facing upwards and the release mechanism 6 is actively securing the chain link 17 in the cavity 21.

In FIG. 11*b* the shoulder 18 and release mechanism 6 is facing downward and the chain link 17 is resting only on the shoulder 18. The release mechanism 6 is passively securing the chain link 17 within the cavity 21.

FIG. 12 shows schematically the actuator system arranged in a free fall lifeboat with one hook. A tank 50 or reservoir is filled with hydraulic fluid. The container is connected to a hydraulic pump 51 and emergency hydraulic pump 52 in case of failure of one of the hydraulic pumps. The pumps can be operated both electrically and by manual pumping, using handles 53. The hydraulic fluid flows through a pressure gauge and an automatic three-way valve to the cylinder 31. The increasing fluid pressure in the cylinder is pressing the piston 31 away (upwards) from the bottom of the cylinder. There are three zones in the cylinder. When the cylinder has a small amount of hydraulic fluid in the cylinder (below the piston), the hook is in the secured position. When the amount of hydraulic fluid exceeds a certain level in the cylinder, the hook is in the releasing phase (intermediate positions). When the amount of hydraulic fluid exceeds this level, the hook is in the released position. The hook can be brought back to the secured, locked position by letting the hydraulic fluid back into the hydraulic tank 50. In this process, the hydraulic tank 50 supplies one hook assembly 1, like in a free-fall lifeboat.

FIG. 13 shows another actuator system for a conventional lifeboat with two hooks, schematically. It has a similar structure as the actuator system in FIG. 11, but supplies two hooks simultaneously so that both hook assemblies release the chain links simultaneously.

FIGS. 14-17 shows different isometric views of the lifeboat hook arrangement 1.

FIG. 14 shows the hook arrangement 1 attached to the lifeboat 2. The lowering arrangement 4 is via the chain link 17 held in a secured position within the hook arrangement 1. The hook 1 is fixed to the lifeboat deck 14 through bolts.

FIG. 15 shows the second part of the hook-shaped beak 5*b* with fixing means 15*a* and the cylinder 28 connected to the underside/inside of the lifeboat deck 14.

FIGS. 16*a* and 16*b* show an isometric view of the hook, viewed from opposite sides, in a locked position. The piston arrangement 31 could rest on guide columns to protect the cylinder 28 but also to prevent unintentional hooking of the release mechanism in the locked position (not shown). A guide column could also be an integrated part of the release mechanism as shown in the FIGS. 16*a*, 16*b*.

There could also be arranged a separate bow shaped device for guiding the chain link back to the hook and preventing accidents as an embodiment of the invention. This is not shown in the Figures.

FIG. 17 shows the hook-shaped beak 5 without the release mechanism 6. It shows the first safety bore 22 and the second safety bore mechanism 16*a*, 16*b*. It also shows the first guide slot 7 and second guide slot 9. A transverse plate 5*c* of the hook-shaped beak is fixedly connected to the lifeboat deck 14. At the underside of the lifeboat deck, the second part of the hook-shaped beak is arranged. There are arranged through holes 13*a* in the second part of the beak to connect fixing means 15*a*-15*g* as shown in FIGS. 4-7 to the beak 5.

FIGS. 18 and 19 show the actuator or piston arrangement 11 in further detail. The piston arrangement in FIG. 18 is secured to the lifeboat through bolts.

FIGS. 20 and 21 show the hook of a freefall lifeboat arrangement, viewed from the outside and the inside of the lifeboat deck 14. The hook arrangement is in this embodiment of the invention attached vertical to the life boat 2 while in the FIGS. 14 and 15 the hook arrangement is arranged horizontally on the lifeboat 2.

FIGS. 22-23 show the hydraulic arrangement connected to the piston arrangement.

FIG. 24 shows a linear solenoid 100 which is another arrangement that could be arranged in connection with the piston to operate the hook. The linear solenoid is an electromechanical unit that converts electrical energy to a linear mechanical movement. The current through the winding creates a magnetic field that creates attractive force between a movable piston and a stop point.

By removing the force from the magnet, the current through the coil is eliminated and the piston moves back to the resting position. The linear solenoid 100 is connected to the piston through the conduits 30 and is preferably arranged on the lifeboat as shown in FIG. 25.

In this Figure, there are arranged two hook arrangements 1 on the bow and aft of the lifeboat 2. As described earlier, the lifeboat 2 could also have only one hook arrangement 1 at the bow or aft of the lifeboat.

There could be other arrangements to operate the hook 1, these being embodiments of the invention.

The lifeboat hook arrangement of the invention can comprise any features as described or illustrated herein, in any operative combination, each such operative combination is an embodiment of the lifeboat hook arrangement of the invention.

The invention claimed is:

1. A lifeboat hook assembly comprising:

a hook-shaped beak;

a release mechanism comprising a wedge;

wherein said hook-shaped beak is rigidly connected to a lifeboat at one end, said hook-shaped beak having a downwardly oriented shoulder against which a loop rests when the lifeboat is suspended in said loop;

wherein said release mechanism is coupled to the hook-shaped beak and is adapted to move relative to the hook-shaped beak between a locked position and a released position;

wherein the release mechanism is self-locking in the locked position;

wherein, in the locked position, the loop is prevented from escaping from the downwardly oriented shoulder;

wherein, in the released position, the loop is allowed to escape from the downwardly oriented shoulder;

an actuator is coupled to the release mechanism and is adapted to move the release mechanism between the locked position and the released position;

wherein said hook-shaped beak or said release mechanism comprises a first guide slot and a second guide slot; and wherein said other of said hook-shaped beak or release mechanism comprises a first guide pin and a second guide pin being arranged within respective guide slots, said first and second guide pin being movable within the respective guide slots between the locked position and the released position, wherein the first guide slot has a curved shape causing the first guide pin to move along a curve so that a movement of the release mechanism follows a rotary path between the locked position and the released position.

2. The lifeboat hook assembly according to claim 1, wherein the release mechanism comprising an edge facing the wedge of the release mechanism is adapted to push the loop away from the shoulder when the release mechanism is moved to the released position.

3. The lifeboat hook assembly according to claim 2, wherein the edge forms an integrated part of the release mechanism.

4. The lifeboat hook assembly according to claim 1, wherein a first end of the first guide slot has an undercut.

5. The lifeboat hook assembly according to claim 1, wherein the actuator is moveable in a direction along a plane parallel with a main axis of a hook arrangement.

6. The lifeboat hook assembly according to claim 1, wherein the second guide slot is shaped as an elongated slot extended along a plane parallel with a main axis of a hook arrangement with a curved second end.

7. The lifeboat hook assembly according to claim 1, wherein the actuator is hydraulic.

8. The lifeboat hook assembly according to claim 1, wherein one hook assembly is arranged on the lifeboat.

9. The lifeboat hook assembly according to claim 1, wherein two hook assemblies are arranged at each end of the lifeboat for simultaneous operation.

10. The lifeboat hook assembly according to claim 1, wherein guide slots are formed in the hook-shaped beak.

11. The lifeboat hook assembly according to claim 1, wherein the lifeboat hook is actuated by a linear solenoid actuator.

12. The lifeboat hook assembly according to claim 1, wherein the hook assembly further comprises a first safety bore arranged on top of the hook-shaped beak for engaging with a securing element.

13. The lifeboat hook assembly according to claim 12, wherein the hook assembly further comprises a second safety bore mechanism arranged on the release mechanism for engagement with a lever for manually rotating the release mechanism.

14. The lifeboat hook assembly according to claim 13, wherein a lever is engaged with the second safety bore of the release mechanism and a corresponding second safety bore of the hook-shaped beak in order to secure the release mechanism in one position.

* * * * *